US005421782A

United States Patent [19]

Lochtefeld

[11] Patent Number: 5,421,782

[45] Date of Patent: Jun. 6, 1995

[54] ACTION RIVER WATER ATTRACTION

[75] Inventor: Thomas J. Lochtefeld, La Jolla, Calif.

[73] Assignee: Light Wave, Inc., La Jolla, Calif.

[21] Appl. No.: 65,467

[22] Filed: May 20, 1993

Related U.S. Application Data

[63] Continuation of Ser. No. 836,100, Feb. 14, 1992, abandoned, which is a continuation-in-part of Ser. No. 722,980, Jun. 28, 1991, abandoned, and a continuation-in-part of Ser. No. 568,278, Aug. 15, 1990, abandoned.

[51] Int. Cl.[6] ..... A63G 21/18

[52] U.S. Cl. ..... 472/117; 472/128; 104/70

[58] Field of Search ..... 472/116, 117, 128; 104/69, 70, 73; 193/2 R, 12, 13; 405/79, 83, 80; 446/153

[56] References Cited

U.S. PATENT DOCUMENTS

| | | | |
|---|---|---|---|
| 419,860 | 1/1890 | Libbey . | |
| 490,484 | 1/1893 | MacKaye . | |
| 799,708 | 9/1905 | Boyce . | |
| 1,648,196 | 11/1927 | Rohmer . | |
| 1,655,498 | 1/1928 | Fisch . | |
| 1,701,842 | 2/1929 | Fisch . | |
| 1,871,215 | 8/1932 | Keller et al. . | |
| 1,884,075 | 10/1932 | Meyers . | |
| 1,926,780 | 9/1933 | Lippincott . | |
| 2,815,951 | 12/1957 | Baldanza . | |
| 3,005,207 | 10/1961 | Matrai . | |
| 3,038,760 | 6/1962 | Crooke . | |
| 3,085,404 | 4/1963 | Smith . | |
| 3,404,635 | 10/1968 | Bacon et al. | 104/70 |
| 3,473,334 | 10/1969 | Drexter . | |
| 3,477,233 | 11/1969 | Andersen . | |
| 3,478,444 | 11/1969 | Presnell et al. . | |
| 3,562,823 | 2/1971 | Koster . | |
| 3,598,402 | 8/1971 | Frenzl . | |
| 3,789,612 | 2/1974 | Richard et al. . | |
| 3,802,697 | 4/1974 | Le Mehaute . | |
| 3,830,161 | 8/1974 | Bacon . | |
| 3,851,476 | 12/1974 | Edwards . | |
| 3,853,067 | 12/1974 | Bacon . | |
| 3,913,332 | 10/1975 | Forsman . | |
| 3,923,301 | 12/1975 | Myers . | |
| 3,930,450 | 1/1976 | Symons . | |
| 3,981,612 | 9/1976 | Bunger et al. . | |
| 4,149,710 | 4/1979 | Rouchard . | |

(List continued on next page:)

FOREIGN PATENT DOCUMENTS

| | | |
|---|---|---|
| 1204629 | 10/1968 | Canada . |
| 1019527 | 10/1952 | France . |
| 1300144 | 6/1962 | France . |
| 1539959 | 8/1968 | France . |

(List continued on next page.)

OTHER PUBLICATIONS

Fauvelle/Blocquel, *Brevet D'Invention,* Sep. 19, 1933.

Hornung/Killen, *A Stationary Oblique Breaking Wave for Laboratory Testing of Surfboards,* Journal of Fluid (List continued on next page.)

*Primary Examiner*—Carl D. Friedman

*Assistant Examiner*—Kent T. Nguyen

*Attorney, Agent, or Firm*—Knobbe, Martens, Olson & Bear

[57] ABSTRACT

An action river water attraction is provided comprising one or more water rides connected to a river loop, wherein the flow of water from a connected ride empowers the flow of water in the river loop. The rider enters a connected ride and then enters the river loop to experience rapid effects. They may then continue to ride the loop until the rider is ready to exit, or can enter into another connected water ride directly from the river loop. A rider can experience the thrill of one water ride and then enter the river loop for an extended amount of time. Various special effects such as lateral flow shears, differential flows at junctions and turns, boils, eddies, whirlpools, backflows and hydraulic jumps. In this manner, the endless river loop serves as the queuing area for riders who are waiting to enter connected water rides.

59 Claims, 15 Drawing Sheets

U.S. PATENT DOCUMENTS

| | | |
|---|---|---|
| 4,194,733 | 3/1980 | Whitehouse, Jr. . |
| 4,196,900 | 4/1980 | Becker et al. . |
| 4,198,043 | 4/1980 | Timbes et al. . |
| 4,201,496 | 5/1980 | Andersen . |
| 4,276,664 | 7/1981 | Baker . |
| 4,278,247 | 7/1981 | Joppe et al. . |
| 4,392,434 | 7/1983 | Durwald et al. . |
| 4,429,867 | 2/1984 | Barber . |
| 4,522,535 | 6/1985 | Bastenhof . |
| 4,539,719 | 9/1985 | Schuster et al. . |
| 4,564,190 | 1/1986 | Frenzl . |
| 4,662,781 | 5/1987 | Tinkler . |
| 4,778,430 | 10/1988 | Goldfarb et al. . |
| 4,790,685 | 12/1988 | Scott et al. . |
| 4,792,260 | 12/1988 | Sauerbier . |
| 4,805,896 | 2/1989 | Moody . |
| 4,805,897 | 2/1989 | Dubeta . |
| 4,836,521 | 6/1989 | Barber . |
| 4,905,987 | 3/1990 | Frenzl . |
| 4,954,014 | 9/1990 | Sauerbier et al. . |

FOREIGN PATENT DOCUMENTS

| | | |
|---|---|---|
| 159793 | 8/1903 | Germany . |
| 373684 | 7/1932 | Germany . |
| 2222594 | 5/1972 | Germany . |
| 2714223 | 10/1978 | Germany . |
| 52-41392 | 3/1977 | Japan . |
| 1090262 | 2/1965 | United Kingdom . |
| 1118083 | 3/1966 | United Kingdom . |
| 1159269 | 11/1967 | United Kingdom . |
| 212138 | 4/1968 | U.S.S.R. . |
| 953075 | 8/1982 | U.S.S.R. . |

OTHER PUBLICATIONS

Mechanics, May 7, 1976, vol. 78, Part 3, pp. 459–484.

Killen, *Model Studies for a Wave Riding Facility,* 7th Australasian Hydraulics and Fluid Mechanics Conference, Brisbane, Aug. 1980.

Killen/Stalker, *A Facility for Wave Riding Research,* 8th Australasian Fluid Mechanics Conference, University of Newcastle, N.S.W., Dec. 2, 1983.

Dunn, *Splash Magazine,* "Wave Action Rivers", Jan. 1992, vol. XI, No. 1.

ACTION RIVER WATER ATTRACTION

This application is a continuation of U.S. Ser. No. 07/836,100, filed Feb. 14, 1992, abandoned, which is a continuation-in-part U.S. Ser. No. 07/722,980, filed Jun. 28, 1991, now abandoned, and U.S. Ser. No. 07/568,278, filed Aug. 15, 1990, now abandoned.

FIELD OF THE INVENTION

The present invention relates in general to an action river loop with various rapid effects, wherein a flowing body of water in the loop is powered by the flow of water from one or more adjacent connected water ride(s). Unique design integration, with a water ride connected to a river loop, enables residual power and velocity from the connected water ride to drive the river loop.

BACKGROUND OF THE INVENTION

The eighties decade has witnessed phenomenal growth in amusement parks consisting primarily of water rides, i.e., the water park. Various types of water rides, including water slides, wave pools, activity pools, flume boat rides, river rides and sheet wave generators, have become especially popular. In fact, one or more of these water rides can be found in nearly every amusement or theme park in the country.

Various reasons contribute to the popularity of these water rides. Some rides, like water slides, provide high speed excitement to the user. Other rides, like wave pools, provide extended time in water and increased throughput. Other rides, like sheet wave generators, simulate real water sport activities like surfing.

Generally, many water park enthusiasts desire the thrill of moving at high speeds down a curvilinear slide, such as a water slide, induced by gravity and water flow. Enthusiasts also find other gravity-induced rides, i.e., flume boat rides, to be exciting. The common element found in these rides is that they are gravity induced, i.e., they must begin at a high elevation and end in a lower elevation, and involve high speeds.

The disadvantage of gravity induced rides, however, is the relatively short ride participation time. An average commercial water slide, for example, has a ride duration of only approximately 30 seconds. Likewise, gravity flow river rides have an average ride-time of approximately one to two minutes.

Another disadvantage of the gravity-induced water ride is that only a few riders can participate at any given time. Due to this limitation, participants are likely to have to wait for a long period of time before being able to participate in the water ride. It is desirable, therefore, to develop a thrilling water ride, but also one that has an extended ride participation time and which can be ridden by many riders at the same time so that riders will not have to wait too long to ride it.

Another common attraction found in water parks, which provides extended user enjoyment time, is the wave pool, or any variation thereof, such as an endless river pool. Large wave pools have been installed at considerable expense, especially in areas where accessibility to nearby natural water bodies is limited. These pools provide extended user participation time and increased throughput as a large number of participants can participate at one time. Wave pools, however, are deep water pools which inherently carry an increased risk of drowning, and which are considered by thrill-seeking riders to provide little user excitement.

In contrast to the traditional wave pools, relatively shallow continuous flow or endless river pools have been installed at water parks throughout the country. Though the circuitous nature of the river pool contributes to extended rider time, previous attempts to design these pools have not incorporated high speed movement or high action flow. Previous rides are more like lazy rivers, with various wave forms created on the river course. Though these lazy rivers are sometimes described as action rivers, they are, in effect, "lazy" in that the water moves at a slow pace in the pool. Periodic waves, such as those created in a wave pool, are merely transposed into an endless river pool system.

Though each form of water ride described above has certain specific advantages, none of the rides incorporate the many desirable elements or features found in all of the rides combined. It would be desirable, therefore, to combine the many advantages found in all the rides and to develop a new approach to water ride design.

In the past, the Selection and placement of the water rides within the water park has been merely a function of site typography or designer fancy rather than planned and systematized ride interdependence. Because of the many disadvantages of the water rides discussed above, a planned and systematized approach to water park design would be advantageous. Especially ideal would be a water ride that incorporates all of the desirable advantages, and which allows continuous user enjoyment and increased throughput, as well as being energy-efficient.

With regard to energy efficiency, current water park design requires separate generators for each water ride. The disadvantage of powering each ride separately is that the kinetic energy generated by one ride is ultimately dissipated or absorbed by the ride itself. None of the energy generated by one ride is converted into energy to generate movement for another ride. Therefore, it would be advantageous to connect water rides together so that the kinetic energy generated by one water ride may be converted and transferred to another.

To develop an efficient system approach to water ride design, a new system approach that utilizes energy from one ride to drive another ride is desired. A new system approach to water park design, therefore, is desirable in view of the limitations and disadvantages of previous water park designs.

SUMMARY OF THE INVENTION

The present invention represents a substantially improved, action river water attraction comprising one or more water rides connected to a river loop, wherein the flow of water from one connected ride can empower the flow of water in the river loop. The present invention advantageously utilizes kinetic energy from one connected ride, such as a sheet wave generator, to empower the flow of water in the river loop. No separate generator is required to drive the flow of water in the river loop.

The present invention contemplates joining one or more water rides with a generally circuitous river course in which the elevation of the water is substantially uniform throughout the course, i.e., a river loop. Because the river loop is substantially uniform in elevation, the body of water, and consequently the rider, can revolve around the course endlessly. The flow of water in the river loop is also predominantly unidirectional. It should be noted that the river course does not necessarily have to be circuitous although that is preferable.

Another advantage of the present invention is that the endless loop design advantageously allows the rider extended user participation time, and therefore, extended user enjoyment time, as the rider may circle the loop any number of times. The rider can enter a connected ride, and then enter the river loop to experience various rapid effects. He may then continue to ride the loop until the rider is ready to exit, or can enter into another connected water ride directly from the river loop. A rider can experience the thrill of one water ride and then enter the river loop for any extended amount of time.

Another distinct advantage of the present invention is that the river loop itself is an action ride with its own rapid effects. The river loop channel is designed so that it creates its own river effects, as well as utilizes kinetic energy from the connected rides, to create various special effects, i.e., lateral flow sheers, differential flows at junctions and turns, boils, eddies, whirlpools, backflows and hydraulic jumps which are not achieved by prior river pools. Moreover, any water ride can be connected to the river loop of the present invention. Also, any ride with sufficient momentum transfer can empower the flow of water in the river loop.

Because the river loop comprises its own ride, and can be relatively large, the present invention has the advantage of increased throughput, i.e., an increase in the number of participants at any given time, and the concomitant increase in the volume of participation.

Another great advantage of the present invention is that it is not two-dimensional, i.e., a number of various desirable features are incorporated in the system. For instance, a rider may experience the thrill of riding on a sheet wave generator, and then experience the excitement of being propelled through a water rapids course, while at the same time being allowed to float about the course endlessly if desired. In another embodiment, the rider can enter an offshoot from the river loop, onto an upwardly climbing flume, which takes the rider to a pool, whereby the rider may, from that point, ride down a conventional water slide which ends up back into the river pool. Any number of water slides or water coaster rides can be incorporated into this system design.

The advantage of having a river loop interconnecting a multiple number of connected rides is that the river loop itself transports the rider from one ride to another, so that the rider does not have to wait in line to participate in another water ride. The endless river loop itself serves as the queuing area for the riders who are waiting to enter a connected attraction. This queuing feature greatly enhances the user's enjoyment, as the queuing area itself comprises its own ride, and the rider does not have to wait for an extended time, as in traditional water parks, to enter another water ride.

In another embodiment, the river loop can be provided with an elevated container from which a large quantity of water may be instantaneously released, creating a surge that flows through the river loop. The surge is in the form of a solitary bore/wave, which travels through the river loop and propels riders around the loop. This surge has the effect of creating a rapid transport, and is in effect an exciting ride by itself.

In another embodiment of the invention, the surge travelling around the river loop may encounter a counter surge, created at various points along the loop. The primary surge which travels in one direction collides with a counter surge in the channel to create a dramatically unique wave effect.

The central component of the action river water attraction system is the river loop, i.e., a circuitous flow of water. This river loop is comprised of a channel or trough, which allows water to travel therethrough. The river loop channel may vary in width, depth, length and shape to create various flow changes and rapid effects, as will be discussed later.

The channel has a depth ranging from approximately 10 cm to approximately 2 meters, although the preferred depth is approximately 1 meter. The depth should be deep enough to allow flotation of riders and avoid drag, and shallow enough to reduce the risk of drowning.

The river loop course can also take on any shape, and can continue for any distance, so long as the kinetic energy of the connected ride or rides is sufficient to empower the flow of water through the entire loop. Generally, the loop is between 100 meters to 1,000 meters in length, and preferably about 300 meters, for a single connected water ride attraction. The river loop can also have offshoots, which are in the form of semi-loops, which can be connected to the main loop.

The preferred embodiment has a channel width of approximately 10 meters, but can range between 3 meters to 15 meters. The channel can be in the shape of a trough, a U-shape, or can have a bottom and two side walls. The river loop channel can be made of concrete, fiberglass, steel, or any other strong material, and can be coated with a sealant or coating. Various topographical formations in the river loop channel can also be created by bolting rubber shapes, like rocks or boulders, which cause various rapid effects in the channel. These formations are advantageously made of rubber to provide safety to the user.

The water in the river loop must be predominantly unidirectional in flow, so that it has the capacity to propel the rider in an endless loop around the course. The river loop itself, however, does not need its own power source, although tangentially oriented secondary and back-up injector boosters may be provided. Preferably, the river loop is powered by the kinetic energy generated by a connected water ride, such as a sheet wave generator, which transfers power and momentum into the river loop in the direction of flow.

For maximum transfer of energy and momentum to occur, the flow from the connected ride must enter the river loop in a direction parallel or tangential with respect to the entry point on the river loop. The flow from the connected water ride must also continue uninterrupted so that little kinetic energy is dissipated or absorbed before reaching the entry point. No pool or stationary area is positioned between the connected ride and the river loop, as they tend to absorb or dissipate the kinetic energy of the water flow.

The water flow from the connected water ride essentially runs off and travels down a channel to the entry point. Preferably, a horizontal surface is located immediately adjacent the river loop at the converging point. Horizontal entry of water flow, on the horizontal surface, provides unidirectional flow, without any upward or downward trajectories or spins, to provide maximum transfer of energy momentum to drive the river loop.

It should be noted that, in the preferred embodiment, the merging bodies of water at the converging point should have substantially the same elevation, just prior to merging, to impart maximum momentum transfer. Equal water surface elevation at the converging point facilitates transfer of momentum, and minimizes energy loss due to excessive turbulence in the channel. Though hydraulic jumps and other effects caused by the merging of flow will increase the elevation, the two bodies generally reach equilibrium as the water moves through the channel.

Water needed to empower the connected water ride is sucked through grates located in the river loop adjacent the connected water ride. A critical feature of the subject invention is the proper orientation of the suction point in the river loop and the discharge point of the water flow from the connected ride. To ensure full loop circulation in a single discharge and suction point attraction, the connected ride discharge must direct the flow of water away from the suction point. This orientation allows the discharge to transfer its momentum to drive the water flow with maximum effectiveness around the course. If the discharge were directed toward the suction point, a short circuit would occur in the flow, and the momentum would be interrupted and full loop circulation would be inhibited, resulting in a "dead zone." By pushing water away from the suction point, the water flow is allowed to circulate the entire length of the loop, until the water returns to the suction point.

Generally, water seeks its own level, or in other words, flows from a high pressure to a low pressure point. In a river loop system, there are theoretically two directions in which the water can travel within the loop. Generally, water within a river loop will tend to flow from a high pressure point, which can occur at the discharge point, to a low pressure point, which can occur at the suction point. However, because the object of the present invention is to achieve a unidirectional flow of water around the loop, the high pressure flow at the discharge point must be directed away from the low pressure suction point. To achieve this directional placement, the flow from the connected ride must be parallel or tangential to the direction of flow. Moreover, and preferably, the high and low pressure points should be separated by at least a distance of 20 feet. Also, at a maximum, the distance between the discharge and suction points should be no greater than one-half the entire length of the river loop. The object is to provide placement of suction and discharge such that they encourage unidirectional flow, and not inhibit it.

Another feature of the present invention relates to the difference in water level between the discharge and suction points. Typically, because water is being sucked from the suction point, the area between the suction point and the discharge point is lower in elevation than the remainder of the river loop. Thus, the tendency is for water to seek its own level and flow from the discharge point back towards the suction point. Even though the discharge is being directed away from the suction point, there may be some backward flow of water towards the lower elevation area. To minimize this counterproductive flow of water against the direction of flow, the discharge point is tangentially positioned with respect to the river loop flow. Moreover, one embodiment of the present invention incorporates a relatively sharp edge on the wall at the discharge point. A sharp edge situated on the wall between the two merging flows, helps prevent backflow of water towards the suction area, as water from the connected water ride has difficulty going around a sharp corner. The sharp edge on the corner, rather than a rounded edge, helps direct water from the connected water ride in the direction of flow.

Another advantage of the present invention is the ability of the system to create various river rapid effects in the river loop channel. These river rapid effects may be caused by various factors, including momentum transfer from a connected water ride, topographical changes in the channel, and changes in river channel dimensions.

Specific effects in the river loop are caused by the supercritical flow of water from a connected ride, such as a sheet wave generator, such as the kind described more fully in application Ser. No. 07/722,980, now abandoned, which is incorporated herein by reference. River rapid effects, including boils, hydraulic jumps, eddies, whirlpools, lateral flow sheers, stationary waves, progressive waves, and standing waves may be accomplished through the introduction of flowing water from the adjacent connected water ride into the river loop.

Such effects are amplified when the water from the discharge point enters a modified area of the river loop channel, such as a turn in the river. As the water enters a turn, the centrifugal force directs the water around the turn and increases the depth of flow on the outside part of the channel at the turn. This high speed flow on the outside of the turn, crossing with the low speed flow on the inside of the turn, creates what is referred to as a lateral current sheer. This fast flow on one bank, and slow flow on the other bank, causes a cross panel sheer, due to the centrifugal forces at work, which rotate the water into a boil or a vortex. Boils and whirlpools are caused by the mixing of water, which is induced by the rotational flow around a turn in the river loop. Where this boil or vortex occurs side-by-side with a hydraulic jump, exotic bubbly swirls may be created. These formations occur because the flow is spinning on two axes—the hydraulic jump has a significant vertical sheer axes, and the river turn creates a significant horizontal sheer axis. These river rapid effects may continue up to 100–200 feet, as they slowly dissipate with the flow of water downstream.

Various effects in the river may also be caused by a change in the river dimensions. Modifications to the depth, width and topography of the river loop channel further adds to the rapid effects. Various stationary and standing waves, as well as white water bores and large differential flow velocities, may be created.

Modifications to the bottom topography of the river loop channel may be accomplished by bolting rubber rocks and formations on the bottom of the channel. The rocks and formations are advantageously made of rubber so that riders traversing over them will not be injured. Because the velocity of flow will be affected by the additional friction caused by these changes in the channel, the velocity must be adjusted, or the modifications reduced, to ensure proper flow around the loop.

Another embodiment of the present invention involves a large surge of water created by an instantaneous release of water from an elevated container of water. This surge, which is commonly known as a solitary bore, is generated by a sudden release of a large volume of water into the river loop. The solitary bore surge effectuates a mass transport of water, which also transports any objects or people caught in the surge. This bore, due to its momentum, can travel all the way around the loop.

In contrast to a periodic wave, a solitary bore generates a substantial displacement and transport of water, and can have a moving wave exceeding two feet in height. Though the solitary bore can be generated intermittently by repeatedly releasing water, it is not a periodic wave, in that the surge transports water in a horizontal direction. This hydraulic concept is known as "mass transport."

In this embodiment, the river loop course has an extended free board, i.e., a vertical water containment wall on either side of the channel, extending 1 meter in height above the water elevation near the discharge, and tapering down to ½ meter in height, near the suction area. A safety net can also be advantageously placed at the first turn to prevent a rider from being propelled by the force of the surge against the outside wall of the channel, which may cause injury to the rider or send the rider over the free board.

In another embodiment of the action river of the present invention, multiple suction from the action river or discharge points into the river can be utilized to maintain certain conditions in the action river and to achieve certain unique effects. Two situations occur that favor two or more suction or discharge points with respect to the action river. First, in the situation where the volume of a surge wave released into the river and/or the suction demand on the river exceeds the flow capacity of the river loop, two or more suction/discharge points are advantageous. In other words, when the surge flow volume is large and/or the suction demand is large and the river loop is not sufficiently broad to permit near instantaneous equalization of river water level, the river water level will build in elevation at the discharge point of entry. Conversely, water will reduce in elevation at the point of suction from the river. The discharge point, for example, might be the point at which a connected water ride merges with the river loop to drive the latter. The suction point, on the other hand, might be, for example, the point at which water is drawn from the river to a sump and pumping station for return to the connected water ride. As the differential and water elevation between these two points increases, there may come a moment when the gravitational restoration force acting on the water level exceeds the force associated with mass transport, and water near the discharge point may reverse direction in the river loop and flow in short circuit fashion toward the suction point. Likewise, a restricted river loop channel and high suction demand can result in an insufficient water level in the sump, resulting in pumped air entrainment and cavitation.

To avoid such flow reversal or possible pump cavitation, additional suction or discharge points may be added to equalize the level of water in the river. An equalizing suction/discharge point might be located downstream from the point of discharge of the connected ride. Another equalizing suction/discharge point may also be located upstream from the existing point of suction. These points can be fluctuated between discharge or suction functions according to water level need. Thus, by introduction of multiple suction and/or discharge points, continuous river flow at tuned and equalized water levels can be achieved in order to permit a wide array of river effects.

A second situation that favors two or more suction or discharge points is the advantage of creating multiple solitary waves, and in particular reverse waves. A reverse wave is created when a second discharge is provided in the river that generates a solitary bore or solitary wave that moves in a direction opposite to that of the general direction of river flow. In one embodiment, a reverse wave created by discharging a flow of water in a horizontal direction and at a tangent to the river loop in a direction that is opposite to the general prevailing flow. In another embodiment, a reverse wave can be generated by introducing a discharge surge of water at a direction which is perpendicular to the flow. Such a perpendicular surge can occur from the top, bottom or side of the flow. Such multiple perpendicular or tangential surges, when properly timed with solitary waves generated by surges flowing in the prevailing direction of flow of the river, can induce dramatic water effects due to counter moving wave collisions.

Thus, multiple suction/discharge points in an action river can be advantageously utilized to achieve many desirable effects, including water level equalization and reverse waves. In addition, the present invention comprises a tool sump chamber for allowing such river entry points to fluctuate between suction points and discharge points. This aspect of the present invention provides maximum flexibility for achieving a wide variety of river effects.

Additional types of water rides, such as water slides and water coasters, may also be installed along the loop, and adapted so that the rider enters the ride from the loop, or from the water park, and exits back into the river loop. Any water rides whether or not it can power the loop, can be installed; the run-off from those rides can cause various ripples and hydraulic effects. Moreover, secondary and backup injection boosters may be placed along the loop, and utilized simultaneously with a connected ride to cause additional effects in the water.

Entry into the river loop is accomplished in a variety of ways. A rider can enter a connected water ride, and then enter the river loop from the connected ride, or may enter the river loop directly. At various points along the river loop, additional connected water rides may be positioned so that the rider may enter directly into the connected ride from the river loop, or directly from the water park. Additionally, a rider may exit from a connected water ride into the river loop. This exit should be designed with coves to prevent other riders in the river loop from colliding with those exiting from the interconnected rides.

River loop exit points can be located along the river loop, comprised of steps or upward flowing ramps. Exit steps are advantageously located on the inside of the curved river loop, as the water on the inside of the curve is slow and less torrential, which makes it easier for the rider to climb out of the river loop.

Various types of connected rides, which generate a volume of runoff water sufficient to transfer momentum and power from the connected ride to an associated river loop course, can be provided. A sheet wave generator, namely a FLOW RIDER TM, is an ideal water ride suitable for efficiently empowering a connected river loop. A FLOW RIDER TM generally comprises an incline upon which various surfing maneuvers can be performed, wherein a supercritical flow of water is injected on and over an incline. The water needed to operate the FLOW RIDER TM may be sucked from the river at the suction point, and then pumped to an elevated container, from which the supercritical flow is generated, or pumped directly onto the incline. The direct water injection system comprises a pump that forces water upward through small nozzle-like openings, from which water is extruded at the proper thickness onto the incline. The nozzles are adjustable so that varying flows can be achieved.

The shallow flow from the FLOW RIDER TM creates a supercritical flow of water which traverses up and over the incline and down the back side. The supercritical flow can also flow up and across a tunnel wave generating device, obliquely positioned on the inclined portion of the ride.

The supercritical flow is also continuous and maintains a relatively constant cross-sectional area down the back side of the incline, although it tends to thicken as the water is slowed down. The back-side channel can also be narrowed to increase the thickness of the supercritical flow at this point. This flow is continuous as there is no supplementary pool located beyond the incline to slow the water down.

This supercritical flow then traverses onto a horizontal surface, preferably 10 feet in length and approximately 6 inches in depth. This substantially horizontal cross-sectional body of water transitions into the river loop to provide maximum transfer of kinetic energy, momentum and power to drive the river loop. It should also be noted that the most efficient transfer can occur at the surface elevation, where the elevation of the in-flowing water is relatively equal to the elevation of the river loop immediately prior to entry.

The supercritical flow, as discharged from the FLOW RIDER TM, must also enter the river loop in a direction parallel to the flow, or tangentially, to encourage the most efficient transfer of momentum in the direction of flow. The constant horizontal cross-sectional body of water also provides unidirectional flow, without any upward or downward trajectories or spins, which would detract from the efficient transfer of momentum. At this juncture, a perpendicular edge on the vertical wall between the two flows assists in preventing backflow of water towards the suction area, as water has difficulty making a right angled turn. Though water generally seeks its own level, because the supercritical flow from the FLOW RIDER TM imparts momentum to the river loop, the water is forced in the direction of flow.

More efficient momentum transfer is also provided by the merger of the FLOW RIDER TM runoff with the river loop. A gradual narrowing of the width of the channel at a point immediately downstream from the entry point accelerates the momentum of the water in the channel. As discussed previously, various river rapid effects are created by the merging of the supercritical flow with the river loop, i.e., boils, eddies, whirlpools, etc.

The FLOW RIDER TM also has an entry slide at various locations. One entry slide is located such that the rider can ride the inclined portion of the ride. Another slide is located on the back side of the incline so that the rider may ride the back side and flow into the river loop. This latter improvement is of particular significance in that it provides a substantial increase to the overall FLOW RIDER TM throughput, i.e., the supercritical flow immediately sweeps an entering back side slide user downstream, allowing the next slider to immediately enter the flow without fear of collision with the previous user as would occur in a conventional water slide that encounters a subcritical flow or pool.

In conjunction with the FLOW RIDER TM, an embodiment of the present invention incorporates a unique reverse slide exit area, located on one side of the incline portion of the FLOW RIDER TM. A rider may exit directly from the containerless incline, by drifting in a direction transverse to the direction of flow towards one side of the incline which is slightly tilted in that direction. The rider may then slide due to gravity down a beveled reverse slide area, located adjacent the incline, into a trough located on one side of the incline, and then can enter the river loop from the trough.

Another water ride ideal for the present invention is a variation of the FLOW RIDER TM in which the FLOW RIDER TM sits in the middle of the river loop. This "Island" FLOW RIDER TM injects water on an incline in the middle of the river to cause unidirectional flow in the river. The suction point is located on the upstream end of the island, and along its sides. A pump then sucks the water from the river, and preferably, to an elevated container, from which a supercritical flow is extruded onto an incline directly adjacent and downstream from the island. As the water is being sucked from the middle of the river, the river loop splits and flows around the island on either side.

The injection can also be achieved by pump and nozzle. The pump is positioned below the nozzle, and forces water through an adjustable horizontal rectangular aperture. The water is extruded through the nozzle to achieve the proper sheet flow thickness to induce the supercritical flow on the FLOW RIDER TM ride surface.

The inclined portion of the FLOW RIDER TM sits in the middle of the river, at an elevation slightly higher than the elevation of the river loop, so that the river flow will not interfere with the supercritical flow. The incline is containerless and allows excess runoff water to flow off the incline.

This particular embodiment of the FLOW RIDER TM also has a slide entrance in the middle, located on a bridge spanning the river, wherein the rider can maneuver to either side of the slide. A slide can also be advantageously placed so that riders may enter on the back side of the inclined portion.

On either side of the slide, there is positioned on the incline, a tunnel wave generating device obliquely positioned in opposite directions, directing respective lateral portions of the supercritical flow toward each split of the river channel flow. The center of the supercritical flow is bifurcated at the ridgeline by the front entry slide. Contoured design analogous to the bow of a boat permits this front entry slide to clear the flow to either side of the slide, which allows the supercritical flow to move in the direction of flow beyond the incline.

The supercritical flow then traverses down the back side of the incline and onto a horizontal portion, wherein the water has a horizontal cross-sectional shape, which imparts maximum momentum transfer and power to drive the river loop. The supercritical flow which traverses up and across the wave generators on either side of the incline is also allowed to flow and run off into the respective river loop splits. This momentum transfer also helps to drive the body of water around the river loop.

In this particular embodiment, a bridge is required that extends across the river to provide entry by virtue of the slides affixed thereto. Also, in this particular embodiment, the supercritical flow is predominantly parallel to the unidirectional flow of the river loop. Thus, this embodiment is ideal for maximum transfer of momentum and power to the river loop. There is no need for a tangentially positioned entry in this embodiment.

Another type of water ride, which may advantageously be connected to the river loop, is a water injected flume. This particular water ride is more particularly described in application Ser. No. 07/568,278, which is incorporated herein by reference. A rider can enter this water ride directly from the river loop. This water injected flume has an upward flow which carries the rider up an incline by means of water jets injected in the direction of flow which imparts momentum to the rider. High speed water jets, with nozzles in the flume, directed in the direction of flow, propel the rider in a horizontal or upward direction. In one embodiment, the flume can progress to a location on top of a mound or hill. At that point, the flume may exit into a pond or pool located at the top of the mound or hill.

A possible embodiment is that, from the pool on top of the mound, a rider may traverse down another water ride, such as a conventional water slide, which leads back to the river loop. Because the mound is at an elevation higher than the river loop, a conventional water slide that propels the rider down a curvilinear path, from a higher elevation to a lower elevation, is ideal. At the bottom of the water slide, the rider exits the ride directly into the river loop. A cove area is provided in the exit area so that riders from the river loop do not collide with exiting riders from the water slide.

Another embodiment of this water injected flume consists of a curvilinear serpentine-like path, with small inclines and declines and horizontal portions spaced throughout. In this particular embodiment, the rider is propelled through the flume by jets of water pointed in the direction of flow, and traverses through curves and changes in elevation, and ends up in the river loop. A river loop exit can also comprise of an upwardly flowing water injected flume, which leads to an exit pool.

The river loop can also be powered by an intermittent release of large quantities of water from an elevated container. This instantaneous release of water causes a surge, commonly referred to as a solitary bore, to move the water through the river loop. This surge effectuates a mass transport, which moves water, as well as anything floating thereon. The shear power of a large body of water travelling through a channel causes the solitary bore to move rapidly through the river loop until the energy begins to dissipate. Once the surge travels through a substantial part of the river loop, the bore will begin to be absorbed by the slower moving water in the river loop, and provides various effects in the river. Nevertheless, the power generated by the singular release of a large quantity of water pushes the water all the way around the loop until the water seeks a uniform elevation. In another embodiment, the primary surge may encounter and collide with counter surges, moving in the opposite direction, created at points along the loop, wherein a unique wave effect is created.

As can be seen from the description of the invention, this system can be large enough to incorporate as many connected rides as is feasible, given the surface area of the water park. Any number of connected water rides may be installed along a long river channel, which may also have interconnected rivers and river loops. Two river loops may be interconnected, one loop inside of another, with a common wall between the two, wherein a surge can be released in one, and cross over into the other. The systemized approach to water park design exemplified by the present invention has few limitations. An entire water park can be designed with a large river loop, with interconnecting rivers and interconnecting rides. The primary advantage of the present invention is that the connected rides can empower the river loop.

DETAILED DESCRIPTION OF THE INVENTION

Figure 1:
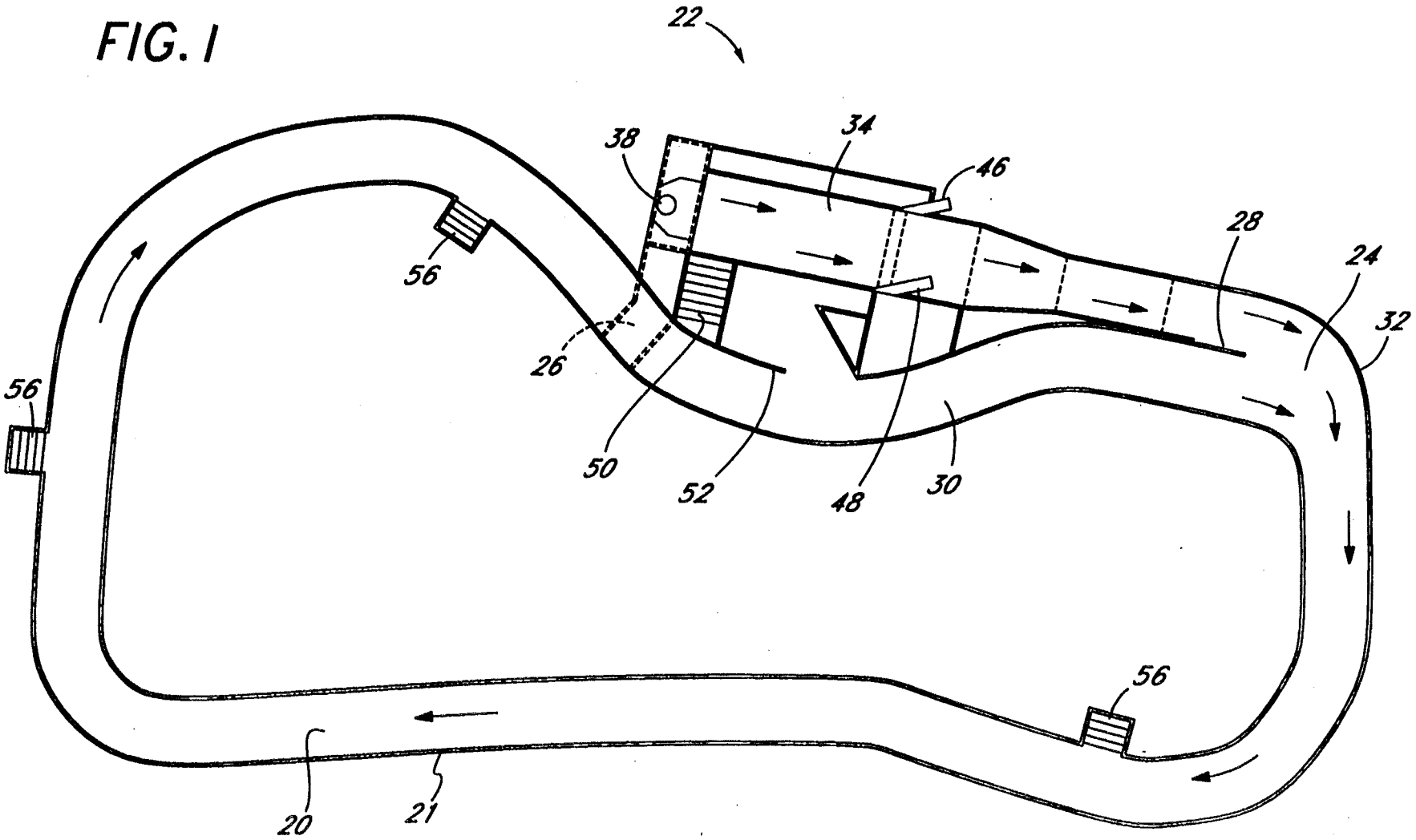
FIG. 1 is a schematic of the river loop of the present invention showing a single connecting ride, such as sheet wave generators.

The present invention shall be described as an action river loop, i.e., a circuitous flow of water with various river rapid effects. FIG. 1 shows the action river loop 20 in one of the preferred embodiments, wherein a single ride 22 is connected to the river loop 20 to drive the flow of water around the loop.

The River Loop

The river loop 20 itself is a channel 21 or trough having a bottom and two sidewalls, the depth of which may vary from 10 centimeters to approximately 2 meters, although preferably the maximum depth is 1 meter. These dimensions are not to be limitations on the present invention, and the actual dimensions may be greater or less. The minimum 10 centimeter depth is provided to ensure that floating devices, such as inner tubes, can float freely down the river course without experiencing drag along the bottom surface of the channel. The preferred maximum 1 meter depth is provided as a safety feature to minimize the risk of drowning within the river loop. A channel 21 with a depth any greater than 1 meter may potentially increase the risk of injury to the rider.

The river loop channel 21 may be of varying width, between 3 meters and 15 meters, depending upon the desired effects to be achieved. Preferably, the width is approximately 10 meters. The width should be large enough to accommodate a number of riders riding side by side down the river channel 21.

The width should also be calculated as a function of cross-sectional area, such that the proper flow characteristics and velocities through the channel are achieved. A narrowing of the channel, and a reduction in the cross-sectional area, can cause the water flow to back up behind the narrow portion. On the other hand, a reduction in cross-sectional area can cause the water to accelerate through the narrow portion, as a function of mass conservation.

Additional variations to the depth and width should also take into consideration the friction caused by the overall surface area of contact between the water and channel 21. A wide shallow channel (e.g., 1×16), having the same cross-sectional area as a narrow deep channel (e.g. 4×4), may have a greater friction component, as the wider channel has a greater surface area exposed to water (e.g., 18 compared to 12).

The channel 21 can also have different cross-sectional shapes, such as a U-shape, or trough shape. The same considerations for ensuring proper flow characteristics and velocities should be considered in creating these various shapes.

In a preferred embodiment of the invention, the bottom surface of the channel 21 may have various changes in topography which cause various hydraulic jumps and stationary waves which are ideal for river riding experience. These changes are achieved by fastening rubber structures, like boulders or rocks, to the channel so that they protrude into the river channel. The placement of the obstructions, however, constricts flow and increases friction, which must be taken into account. The design of the topography can be achieved, however, on a trial and error basis as the rubber formations may be fastened or removed after the main channel is in place.

The channel 21 itself can be made of concrete or any other strong material, such as fiberglass, or steel, and can be coated. Preferably, the channel 21 will be built into the ground along a substantially uniform elevation course. A feature of the action river loop 20 is that the loop is substantially uniform in elevation, such that the water flows endlessly in a circuitous fashion around the channel 21.

In general, the length of the loop 20 can be between 100 meters and 1,000 meters, although the preferred length is 300 meters. The length of the river loop 20 is also a function of the total volume of water being driven around the course, as well as the residual power being transferred from the connected water ride or rides. In the case of multiple connected rides, a larger river loop with increased volume of water is feasible.

Transfer of Momentum and Energy

Another feature of the present invention is that due to the circuitous nature of the river loop 20, a unidirectional flow can be sustained. The object of the present invention is that the movement of water in the river loop is predominantly in one direction, and that the flow is achieved by kinetic energy transferred from a connected water ride. Tangential surface orientation enables the kinetic energy of run-off water to efficiently transfer its momentum and to power an associated river loop course. The velocity of the river course is subcritical, and is a function of the flow characteristics of the connected ride or rides, and the dimension characteristics of the river channel.

Though the action river loop 20 somewhat resembles what is known in the art as a lazy river, the primary object of a lazy river is to provide a slow moving flow of water, whereas the present invention relates to a river with a variety of rapid effects. Also, conventional lazy river courses have been powered by pumps that jet water from a multiplicity of piped manifolds located upon its bottom or sides. In contrast to the lazy river, the action river loop 20 envisioned by the subject invention forgoes the cost of piped manifolds by utilizing run-off water exiting from a connected ride 22 to serve in a co-generative capacity to drive the water in the river loop course. Large run-off flows from a connected ride can result in strong and varied flow conditions that are highly prized by river riders. It should be noted that secondary and back-up generators may also be installed along the river loop, which may be utilized simultaneously with the connected rides, to generate various rapid effects, including periodic waves.

The unique integration of the connected ride 22 and the river loop 20 affects a highly efficient and cost-effective transfer of momentum and power. To achieve this transfer of momentum, proper orientation of the river course to the connected ride is required. In particular, water must first be pumped from the river loop 20, and then discharged from the connected water ride by run-off at proper locations. Maximum drive with minimum energy loss to a hydraulic jump at the convergence of run-off water and water in the river loop 20 is a function of two components: (1) introducing run-off water at the proper surface elevation of water in the river loop, and (2) introducing run-off water in a direction parallel or at least tangential to the direction of flow within the river loop.

The first requirement can be achieved by directing the run-off water onto a horizontal surface, thereby properly orienting the body of water in a unidirectional flow to provide maximum transfer of energy, as can be seen in FIG. 1. Upward or downward trajectories or spins are undesirable, in view of the fact that the horizontal convergence at this point is what drives the water in the river loop. Optimally, the horizontal surface should be at least 4 feet in length, and preferably 10 feet in length. The depth, at this point, is the depth of the supercritical flow just prior to river loop entry, which is a function of supercritical flow velocity and channel width. Preferably, the depth should be approximately 6 inches in depth, to provide efficient transfer of momentum to the river loop 20. Immediately prior to entry 24, the elevation of the two merging bodies of water should also be substantially the same, so that unusual spins or trajectories do not detract from the driving effect of the flow. Also, at the point of entry, there is a drop off from the horizontal surface, from an approximate 6" depth to the depth of the river, approximately 1 meter.

To achieve the second requirement, the connected water ride must be positioned such that the run-off enters the river loop in a direction substantially parallel or at least tangential to the flow within the river loop. The run-off must also be continuous, with minimal energy loss; no supplementary pool or exiting area is contemplated in the present invention. In fact, a pool would make it less efficient for the energy to be transferred to the river.

In one preferred embodiment, the river loop immediately downstream from the converging point 24 gradually narrows so that the two converging bodies of water merge. By merging the two bodies of water together, the kinetic energy is effectively transferred, and the two bodies of water eventually reach a substantially equilibrium flow. Also, by reducing the cross-sectional area slightly, an accelerated flow through the channel can be achieved.

Orientation of Suction and Discharge

The proper orientation of the suction and discharge is also critical. As water is being sucked from the river loop, the resultant downstream flow 30 is relatively lower in elevation and slightly slower when compared to the remainder of the river loop flow. To achieve a unidirectional flow, it is necessary to ensure that the run-off water at the converging area 24 flows away from the suction area 26 and does not flow backwards to the suction area. In the absence of sufficient momentum transfer in the direction of flow, the water being discharged will tend to seek its own level by spilling back into the lower elevation area 30. To minimize this tendency, the run-off must be at a sufficient velocity and volume, as well as in the direction of desired flow. Also, the wall 28 dividing the run-off from the river loop 20, should have, at its end, a right angle edge which directs the flow forward, rather than a rounded edge, which tends to allow water to wrap around and back. See FIG. 1.

In practice, suction inlets 26 in the river loop 20 need to be placed near the discharge area 24, so as to minimize the length of the slow moving lower elevation area 30. However, the suction points 26 cannot be too close to the discharge area 24, so that the flow of water is significantly influenced by the pressure field created from the suction area. As the discharge area 24 is at high pressure, and the suction area 26 is at low pressure, a pressure field is created so that the water will tend to flow from the discharge area to the suction area, if all other things were equal. Because the pressure field falls off at a rate of one divided by the distance from the point 26 of suction, a minimum distance of approximately 20 feet between the suction point 26 and the discharge point 24 is preferred. At a maximum, the discharge and suction areas should not be separated by greater than one-half the entire distance of the river loop 20.

Placement of the connected rides and the discharge points can also be strategically designed to maximize desired rapid effects in the river water course. By placing a turn 32 in the river loop 20 immediately downstream from the discharge point 24, as shown in FIG. 1, various unique rapid effects are created, i.e., surging effects that generate differential flow velocities, boils, eddies, whirlpools, backflows, flow sheers, etc. In particular, boils are caused by the rotation created by a turn in the river, interacting with an induced hydraulic jump. Centrifugal force at the river turn forces the water to flow up and against the outside wall of the turn. This changes the local Froude number and also induces a lateral current sheer. A current sheer is generated by the high speed flow on the outside of the turn, cross-panelling with the low-speed flow on the inside of a turn. This cross-panel sheer is created by the balancing of centrifugal forces in the turn, and generates a rotation of movement known as a boil or vortex. In conjunction with a boil, exotic bubbly swirls are also created when a hydraulic jump is induced to interact with the boil. Exotic bubbly swirls can occur due to the vertical and horizontal components of the respective sheers, caused by the introduction of a hydraulic jump.

Introduction of run-off water from a connected ride 22 at various tangential angles can also vary the rapid effects generated in the river loop 20. The tangential angle entry can also be combined with variations in topography and river loop configuration to form any number of different rapid effects.

Sheet Wave Generator

Figure 4:
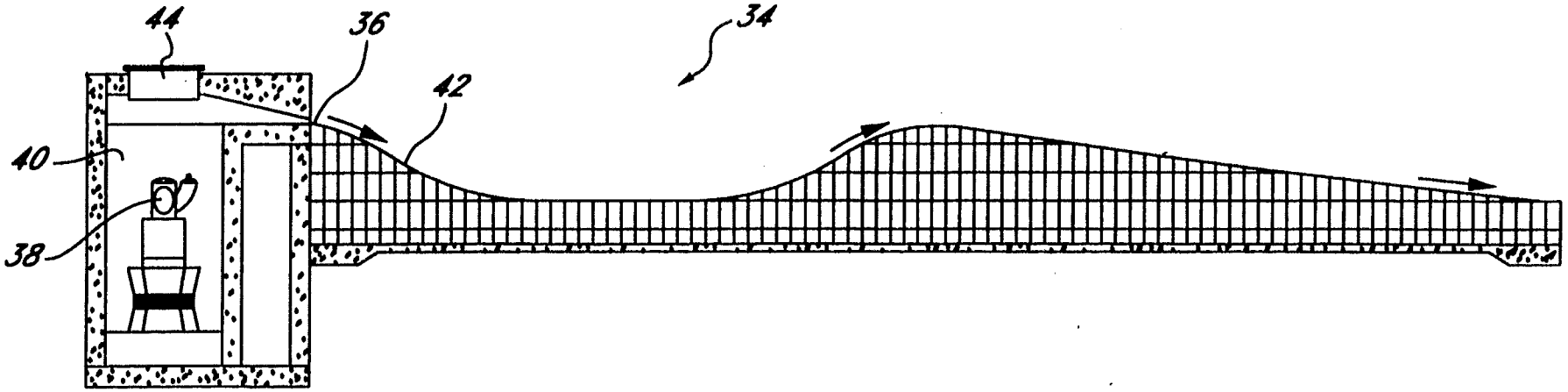
FIG. 4 is a cross-sectional view of a sheet wave generator taken along line 4—4 of FIG. 2.

FIG. 4 shows a cross-sectional view of a sheet wave generator, i.e., a FLOW RIDER TM 34 apparatus, in one embodiment of the invention. Though many types of connected rides are feasible, the FLOW RIDER TM is ideal as it generates a massive flow of water, varying from 50,000 gallons/min., for the supercritical flow, to 250,000 gallons/min., for the surge to be discussed later in more detail.

To operate the FLOW RIDER TM, water is sucked from the river loop 20 primarily by the pump 38 located adjacent the river loop. The pump 38 is located in a large cavity 40 adjacent the nozzles 36, which inject the supercritical flow onto the incline 42. In one embodiment, the pump 38 forces water upward against the top of the cavity 40, where the water is extruded through small adjustable nozzle openings 36 to create a supercritical sheet flow on the FLOW RIDER TM incline 42, as can be seen in FIG. 4. The velocity of the water being extruded from the nozzles 36 is a function of the water pressure being exerted by the pump 38. The nozzles 36 can be adjusted to create varying sheet flow effects.

In another embodiment of the invention, a pump 38 can circulate water into an upper container 44 or reservoir, elevated above the incline 42, from which the water is extruded through nozzles 36 underneath to create a similar effect. The advantage of this embodiment is that a large surge effect can be created by opening the nozzles 36 and releasing a large volume of water instantaneously.

Figure 2:
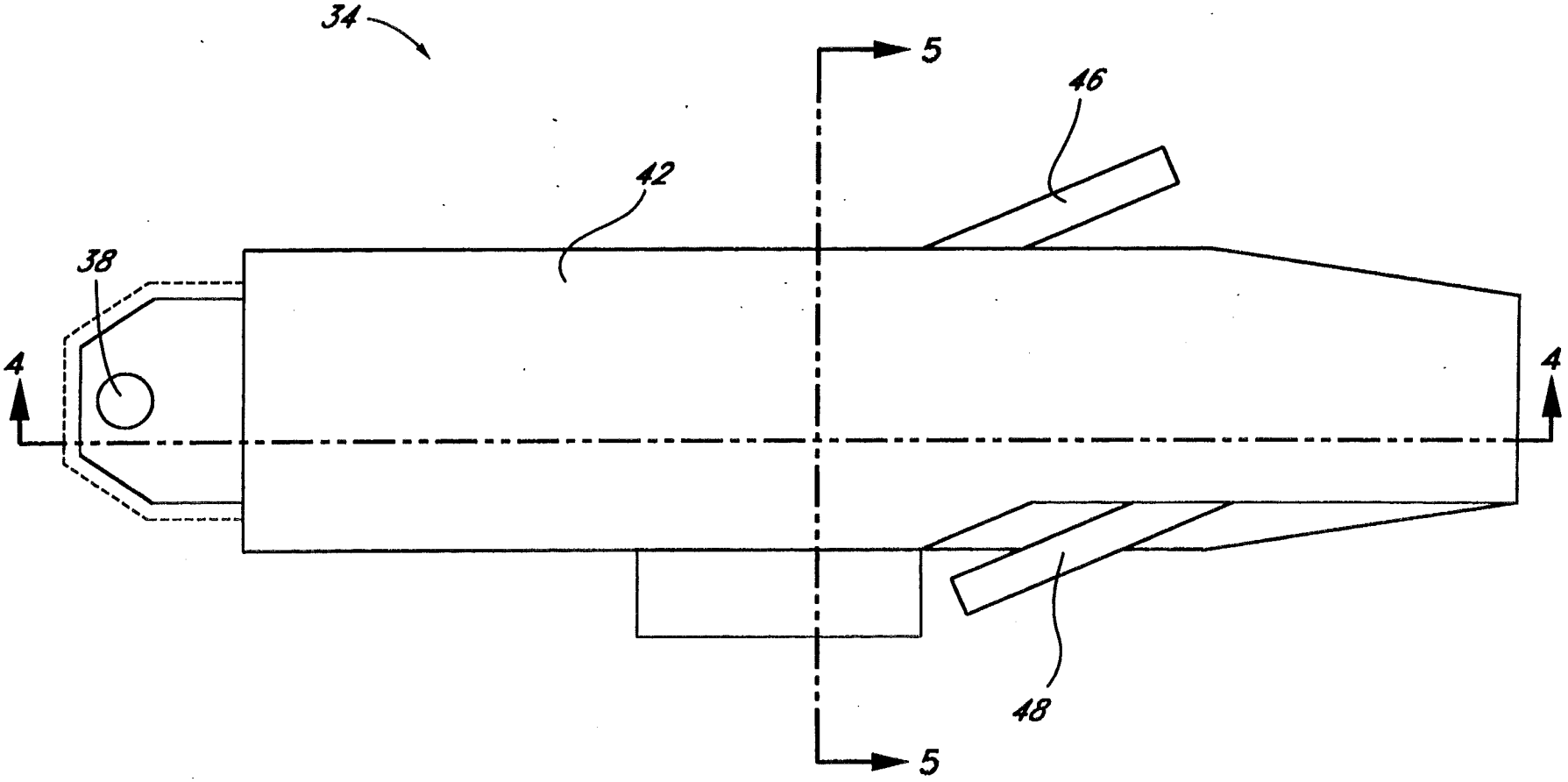
FIG. 2 is a top plan view of a sheet wave generator water ride.

A rider enters a FLOW RIDER TM by traversing down a slide 46 connected to the water ride, such that the rider slides against the flow of water, as can be seen in FIG. 2. The rider is then able to maneuver and perform surfing maneuvers on the incline 42. Another slide 48 can be positioned on the back side of a FLOW RIDER TM such that the rider exits the slide in the direction of flow and directly into the river loop 20. A rider who slides down into this supercritical flow is immediately washed away, thus allowing subsequent rider entry without the typical delays associated with a conventional subcritical slide, which splashes into a pool.

Figure 3:
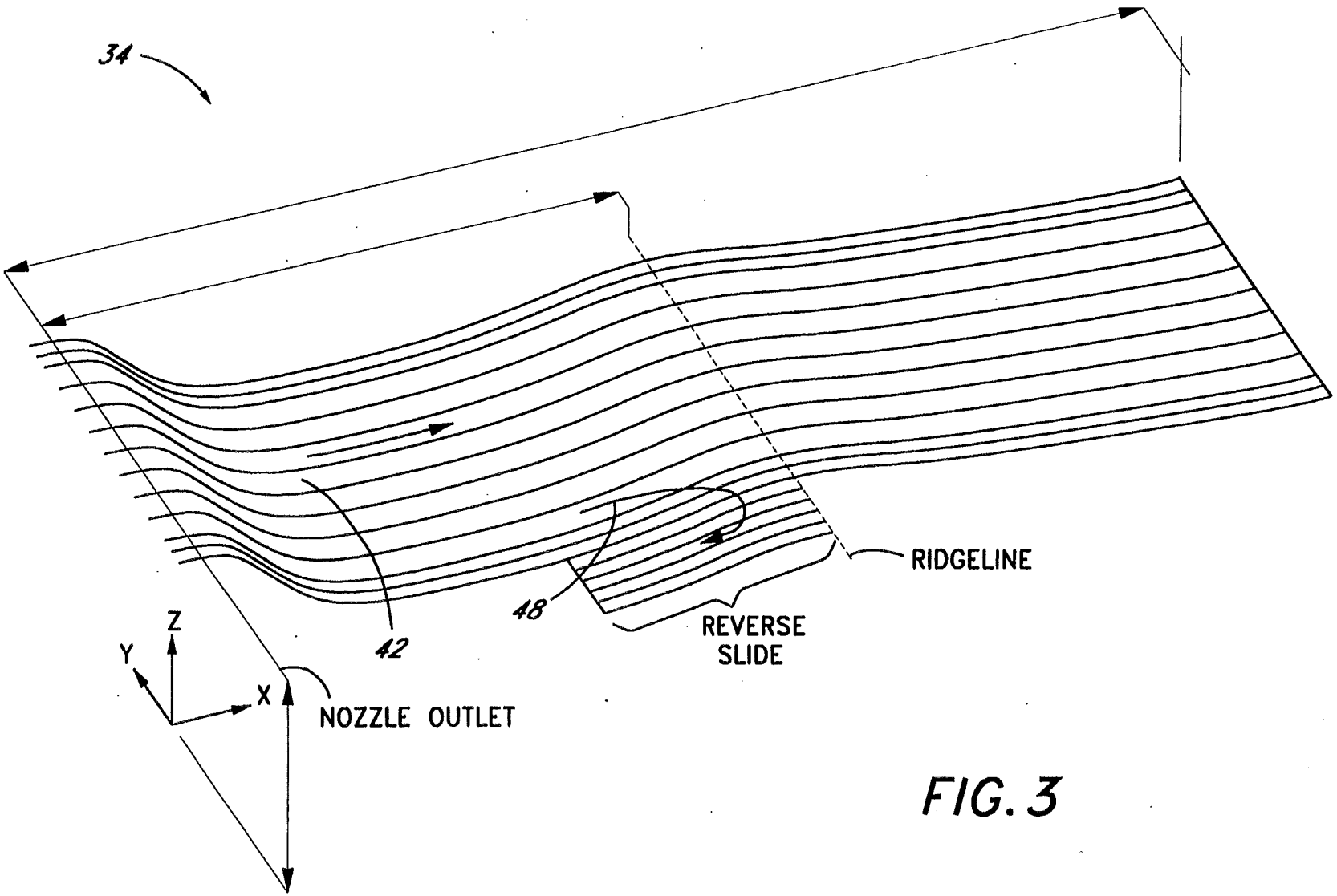
FIG. 3 is an illustration of the inclines and water flow of a sheet wave generator, showing the reverse slide.
Figure 5:
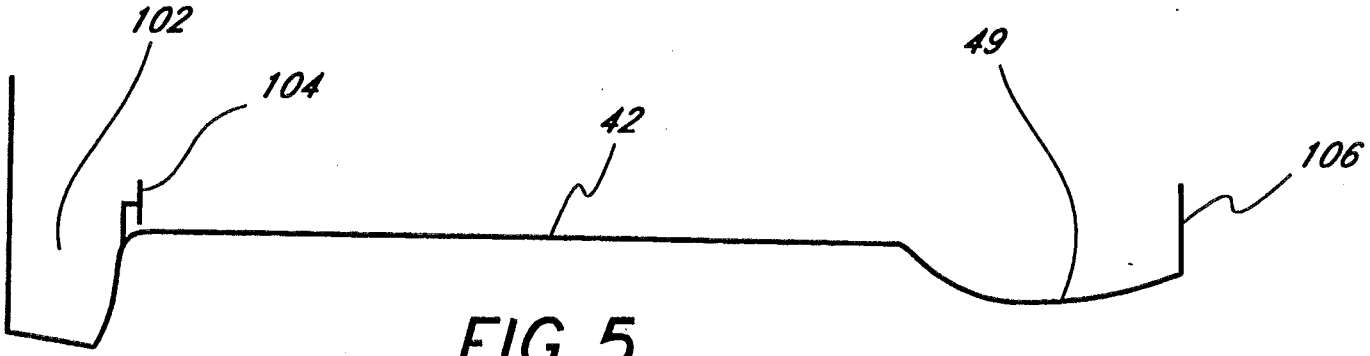
FIG. 5 is a cross-sectional view of the inclined surface of a sheet wave generator, taken along line 5—5 of FIG. 2, and showing the reverse slide.

One improvement to the FLOW RIDER TM is a unique reverse slide exit area, located on one side of the incline portion of the FLOW RIDER TM, as can be seen in FIG. 3 The reverse slide comprises a concave, beveled slide area, as can be seen in FIG. 5, built onto the incline portion of the ride, which exits into a trough 49 located adjacent the ride. As a rider drifts to one side of the incline, which is tilted slightly in that direction transverse to the direction of flow, the rider can move to one side and enter the reverse slide. From there, the rider can exit the ride, and enter the pool, and then enter the river loop.

The width of the FLOW RIDER TM injection point is slightly less than the width of the incline at the ridge, which allows the supercritical flow to spread out along the incline, and reach a subcritical flow on the sides. On the side of the incline with the reverse slide, water reaches a subcritical flow, and begins to flow off and back down the incline, on the reverse slide. The water, and the rider, then flows from the slide into the trough. On the other side of the incline is located another trough 102, but a net 104 is placed so that only water will flow off the incline.

A containment wall 106 is also located on the outer peripheries of the reverse slide area, but is situated so that it does not affect the supercritical flow on the incline. The wall merely helps to maintain the rider on the reverse slide area, but does not extend onto the incline area where the supercritical flow may be affected.

A rider may exit the river loop by means of several exit steps 56, as shown in FIG. 1, positioned on the inside downstream part of a river loop turn 52, as the inside water is relatively slow and non-torrential. Because the water is slower at this point, riders can more easily exit the water ride without being caught in the movement of the water flow. A rider can also exit from an upward ramp, tangentially situated along the loop, much like the water injected flume to be discussed later. In one embodiment, the upward ramp feeds into an elevated container or exit pool, which supplies water to the FLOW RIDER TM.

Island FLOW RIDER TM

Figure 6:
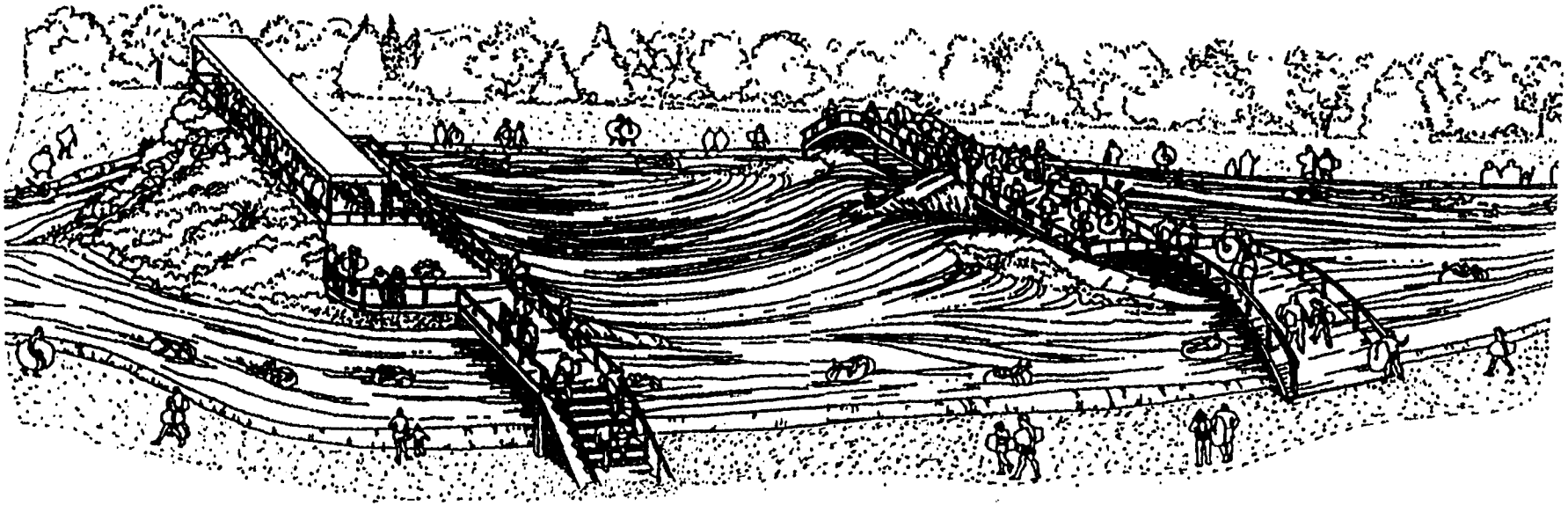
FIG. 6 is an alternative embodiment of a connecting ride in the river loop of FIG. 1 comprising an island sheet wave generator.

FIG. 6 shows a preferred embodiment of the present invention, where a FLOW RIDER TM device is situated in the middle of the river loop channel. In this embodiment, an island is placed directly in the middle of the channel, which houses the pump with the nozzles for injecting the supercritical flow. The water is sucked from an inlet area located on the upstream side of the island and along its sides. The inlet area consists of one or more grates which allow water to pass through, but protects riders from being sucked into the opening. An elevated container can also be used in this embodiment with nozzles located below.

In this embodiment, the incline upon which surfing maneuvers can be performed, is also situated in the middle of the river channel. The incline is slightly higher in elevation with respect to the elevation of the river flow, so that the supercritical flow can run off the sides and into the river loop, but the river water does not affect the supercritical flow. The supercritical flow moves up the incline, which has two separate tunnel wave generators obliquely positioned on either side of the incline. Each tunnel wave generator obliquely faces outward such that the water flowing up and across the wave generator flows towards the outer shores of the channel. Positioned between the wave generators is a double entry slide from a bridge which spans the river channel.

The supercritical flow moves up the incline, where it flows between the wave generators and over the central ridge on the incline and down the back side. One or more entry slides can be positioned on the back side of the bridge, such that riders may enter the ride on the back side of the incline. The supercritical flow moving down the back side enters a horizontal area, wherein the body of water is at an elevation substantially equal to the elevation of the river loop, and merges with the river flow and drives the water around the river loop.

Surge With solitary Bore

Figure 7:
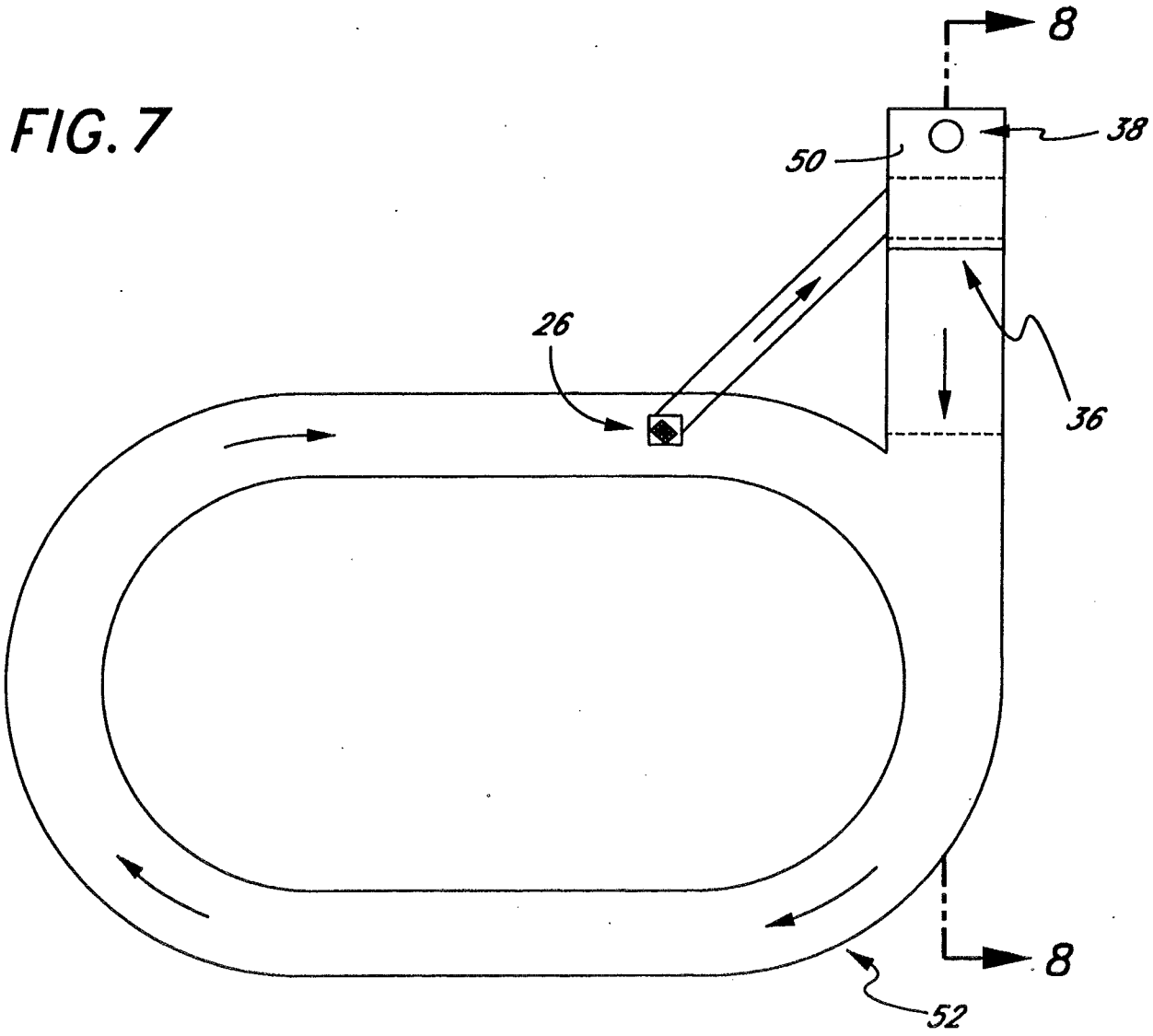
FIG. 7 is a schematic of a river loop with a surge generating device connected thereto.

In one embodiment of the present invention, as can be seen in FIG. 7, a massive surge can be generated by releasing a large quantity of water from an elevated container 50 which feeds into the river loop. By introducing a large mass of water, a surge or solitary bore is created which travels at relatively high speeds through the channel of the river loop. In some instances, the water can reach a velocity of 30 ft/sec. The solitary bore advantageously induces rapid movement within the channel which, in combination with the various changes in depth and topography in the channel, creates its own unique rapid effects. Moreover, a rider may be transported by the moving mass of water around the river loop much like a tidal surge. In this embodiment of the invention, the river loop course immediately downstream from the release point should be relatively straight so that the solitary bore will not force riders up against a turning point in the river loop. As long as the turn is gradual, the rider will have a chance to maneuver around the turn as the surge travels through the channel.

In the event the surge hits a turn in the wall 52, the wall should be built up at that point extending above the surface elevation of the water. The freeboard can be as high as 1 meter above the water surface for the first 50 meters or so, and then can taper to ½ meter at the suction area. A safety net can also be placed to prevent riders from hitting the wall 52 or being propelled over the containment wall.

Figure 8:
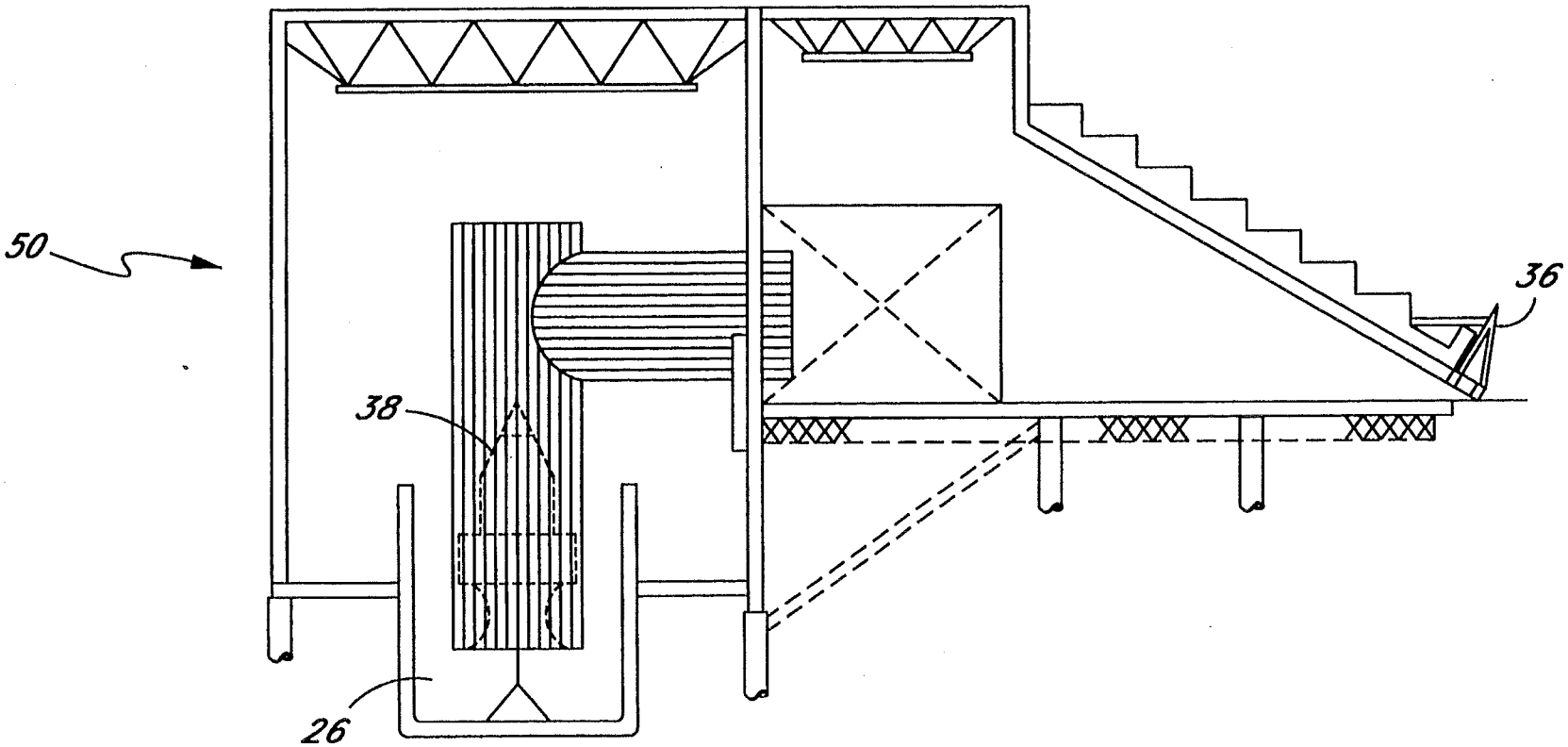
FIG. 8 is a cross-sectional view of the surge generating device taken along 8—8 of FIG. 7.
Figure 9:
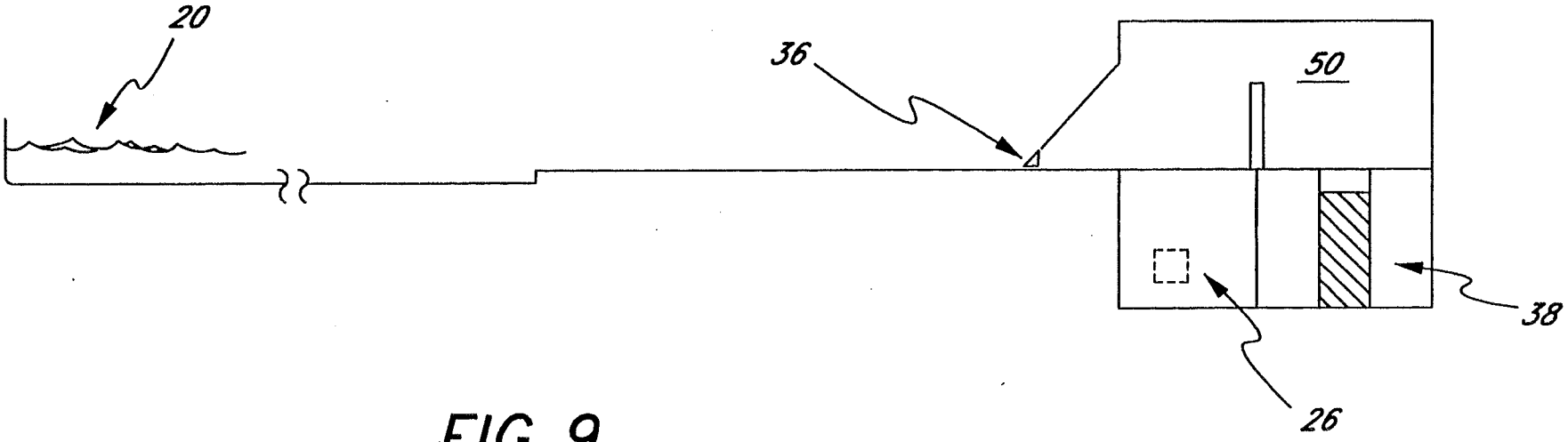
FIG. 9 is a cross-section of the surge generating device and adjacent river loop.

The elevated container 50, which induces the surge, should be large enough to contain a large quantity of water to achieve the desired effects. This container 50 is shown in FIGS. 8 and 9. Preferably, the same elevated container used to operate a FLOW RIDER TM 34 can be modified to allow a large quantity of water to be released instantaneously. In fact, the nozzles 36 of the FLOW RIDER TM can be adjusted so that the openings are large enough to release a torrential flow instantaneously. The area below can also be modified so that the surface is a continuously declining channel reaching a horizontal orientation immediately prior to entering the river loop 20, as shown in FIG. 9.

Multiple Suction/Discharge Points and Reverse Waves

In another aspect of the present invention, multiple entry points into the looped action river can be utilized in order to achieve a wide variety of advantageous effects, including water level equalization and dramatic reverse wave and colliding wave effects. In this aspect of the invention, one or more additional entry points to the river are added over and above the discharge point provided from the connected ride for powering the river. In this case, the entry point can serve either as a discharge point or a suction point, as coordinated with the pump. Preferably, the entry point comprises a grate located at the bottom of the river; however, such a grate could also be situated at the side of the river or even above it where unique wave effects could be generated by a discharge of water substantially perpendicular to the water level in the river. Furthermore, a grate is .only one example of an entry point for the river, and the principles of the present invention are not limited to such an embodiment.

Figure 10:
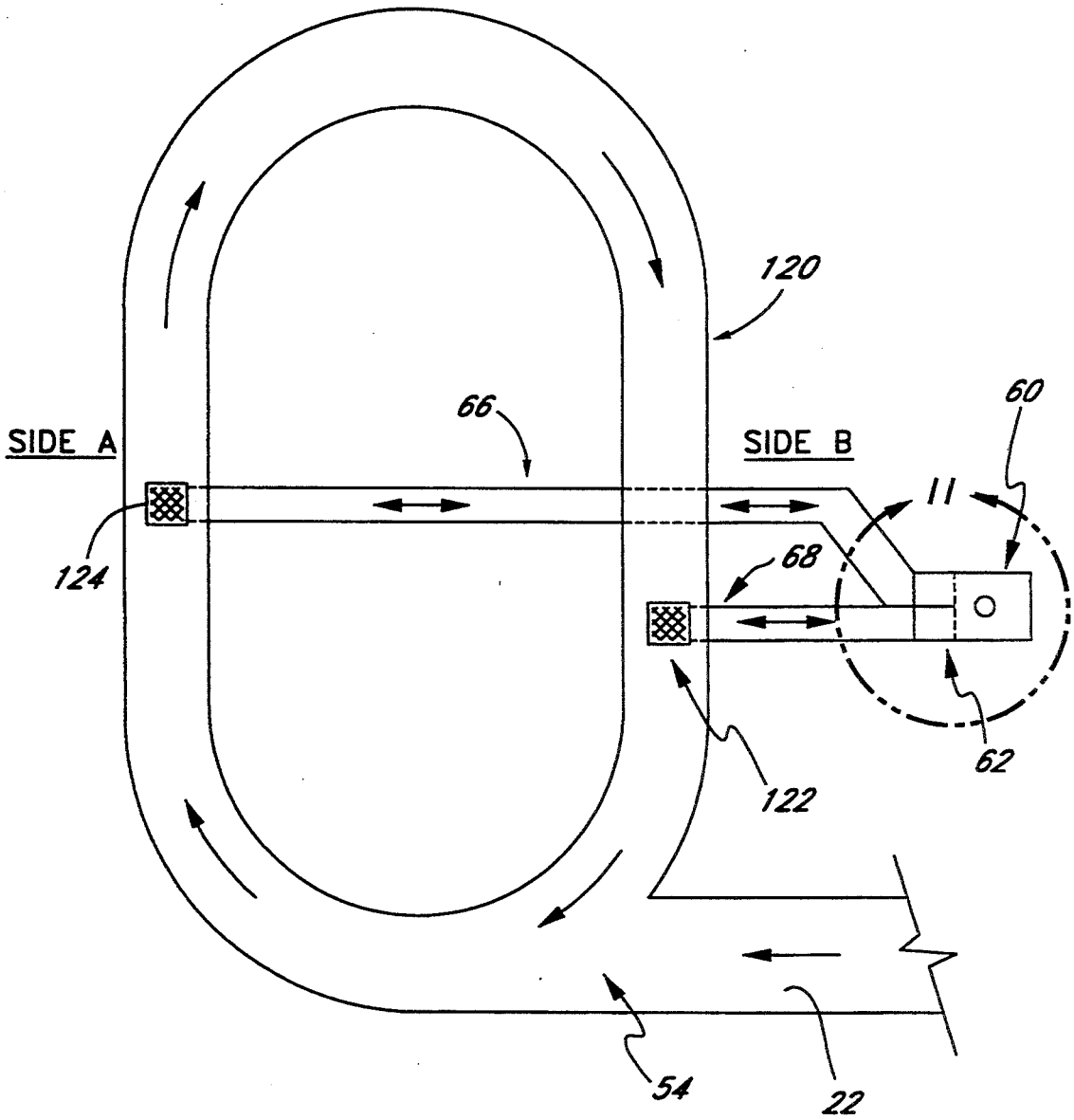
FIG. 10 is a top plan view of another embodiment of an action river loop of the present invention incorporating multiple suction/discharge points for water level equalization and generation of unique reverse wave effects.

With reference to FIG. 10, there is shown an oval-shaped looped action river 120 which can be used to describe the advantages of this aspect of the present invention. It should be pointed out, however, that the looped river course can comprise any shape or configuration, and is not limited to an oval course. However, for simplicity, the oval of FIG. 10 illustrates these aspects, including the flow of water in a general clockwise direction. FIG. 10 also illustrates sides A and B of the river course, separated at each end by curved river sections. At one end, a connected water ride 22 is shown merging with the river in a tangential direction to form a discharge point 54 at the curved portion. As explained in more detail above, this connected water ride provides kinetic energy to power the river and produce transport of its occupants. In addition, the connected water ride can, from time to time, provide a surge of water at the discharge point in order to generate a solitary bore or solitary wave which moves about the river in the prevailing direction of flow.

FIG. 10 also illustrates a first entry, referred to as grate #22 (122) located on side B of the river not far upstream from the discharge point of the connected ride. In an embodiment of an action river of the present invention as illustrated in FIG. 1, this grate would serve as the principal suction point for the river. However, in accordance with this aspect of the present invention, and as described below in more detail, grate #2 (122) can serve either as a suction or discharge with respect to the river in order to create advantageous effects.

A second entry is shown on side A of the river which is downstream of the discharge point and upstream of grate #2 (122). This second entry point comprises a grate #1 (124).

Grates #1 and #2 are connected by respective sump channels 66 and 68 which flow beneath the river course and merge at a common sump 62 illustrated at the right portion of FIG. 10. Positioned in the sump 62 is a pump 60. The sump is characterized by a dual diversion chamber 63 which coordinates the function and fluctuation of the grates #1 and #2 and which is illustrated in FIGS. 11 and 12 and described below in more detail.

With the arrangement illustrated in FIG. 10, the water level of the river course can be easily equalized and maintained at the desired level. For example, in a manner described below in more detail, grates #1 and #2 can each, individually, alternate between suction and discharge modes. For example, in order to avoid high water levels in the river in the area of grate #2, and possible resultant reverse flow, both grates #1 and #2 can function as a dual suction in order to equalize the water level. Furthermore, in order to avoid pump cavitation, grate #1 can act as a supplemental discharge point, while grate #2 continues to act in its normal suction mode. Thus, with one or more additional suction/discharge entry points for the river, desired water level and other effects can be achieved.

Figure 12:
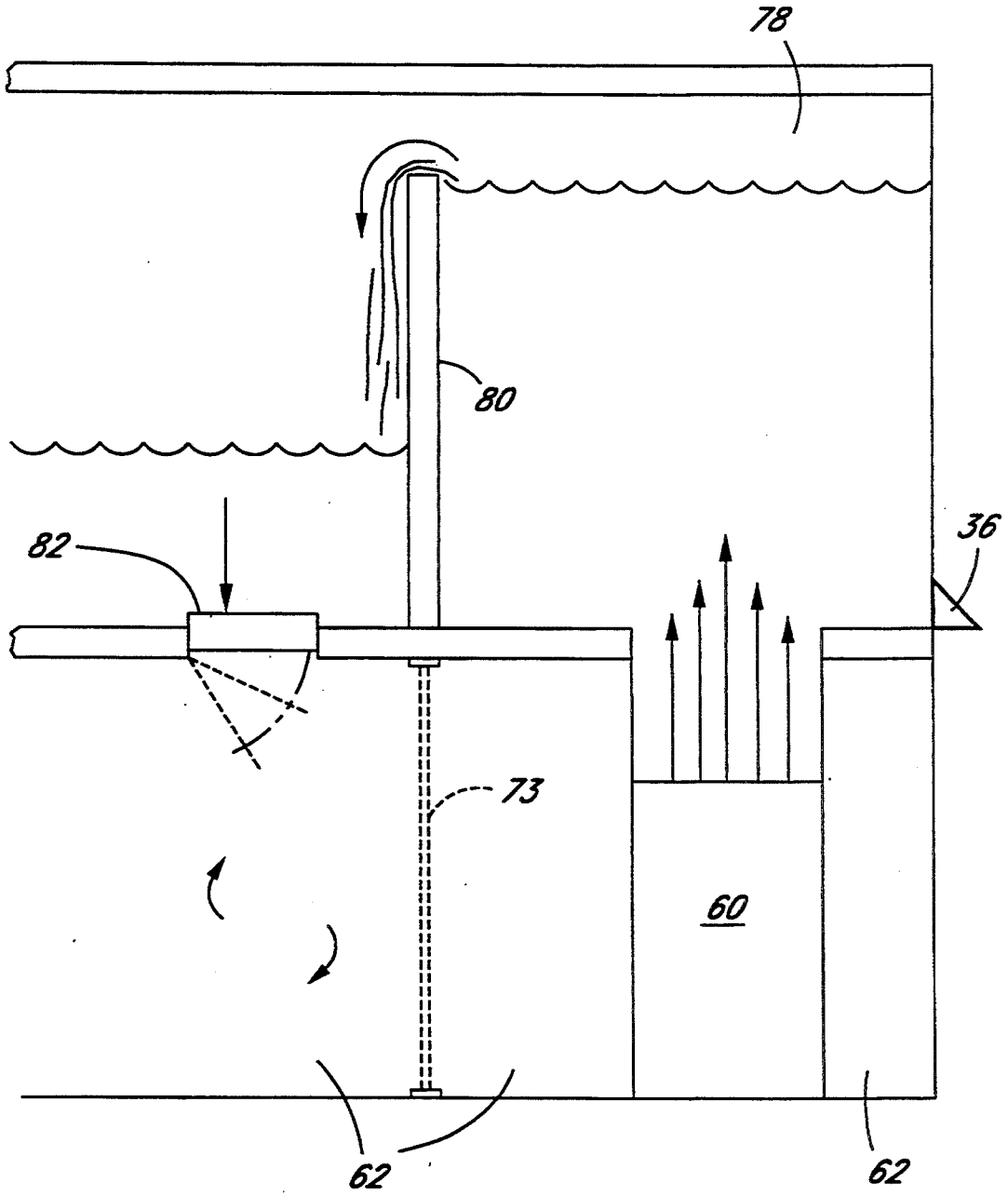
FIG. 12 is a side elevational view of the sump chamber of FIG. 11.
Figure 13:
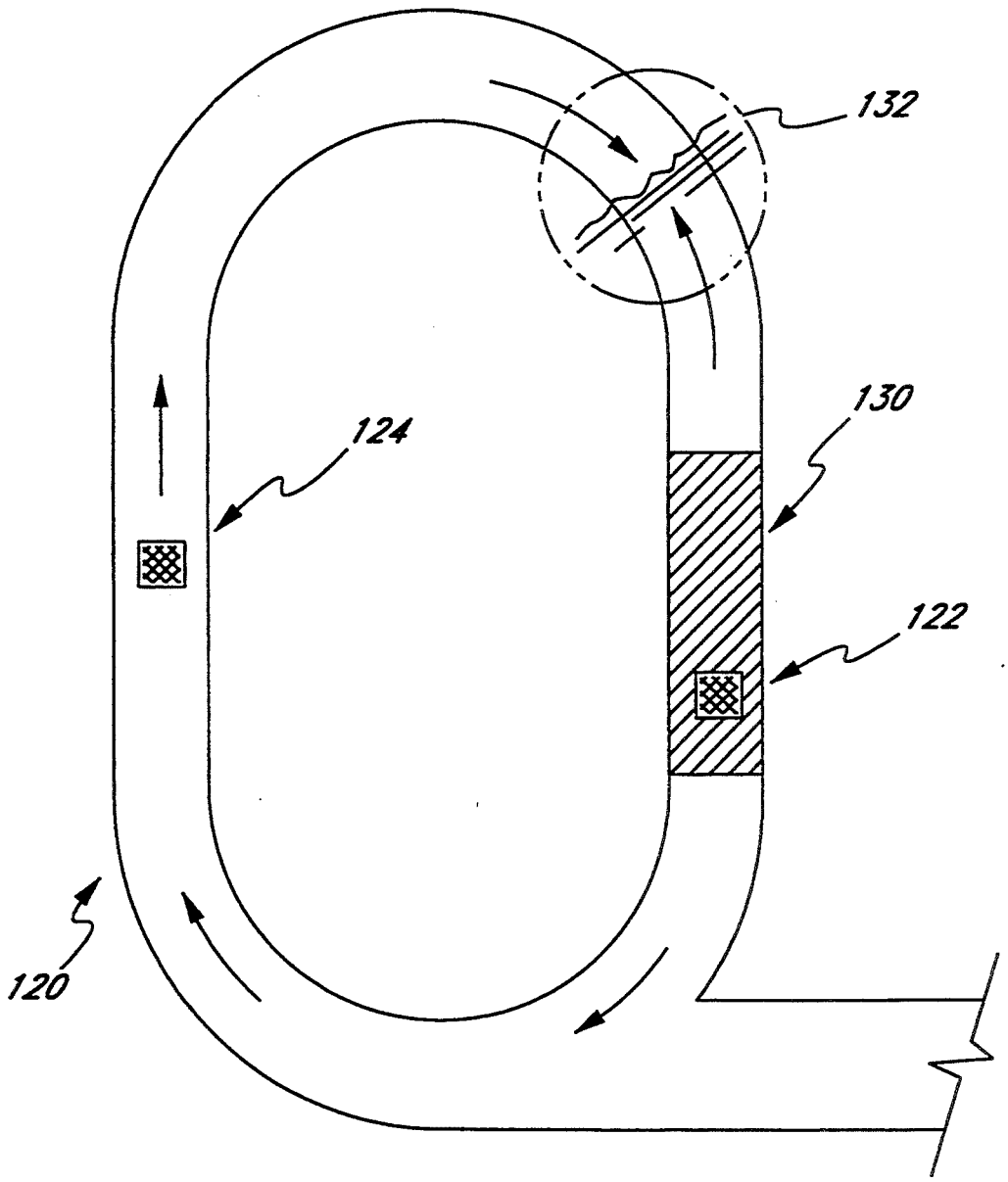
FIG. 13 is a top plan view of the action river of FIG. 10, illustrating the reverse wave effects achievable by said water traction.
Figure 14A:
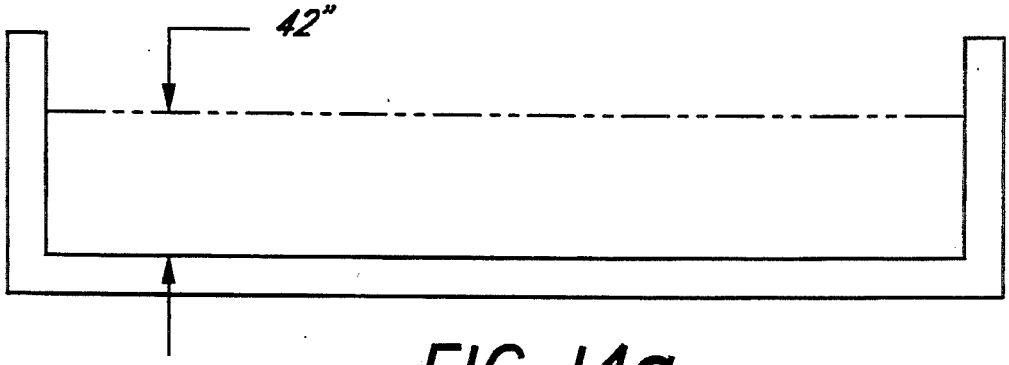
FIGS. 14*a–e* are cross-sectional views taken through the action river of FIG. 13, illustrating the water level at various points in time during the creation of the reverse wave effects therein.
Figure 14B:
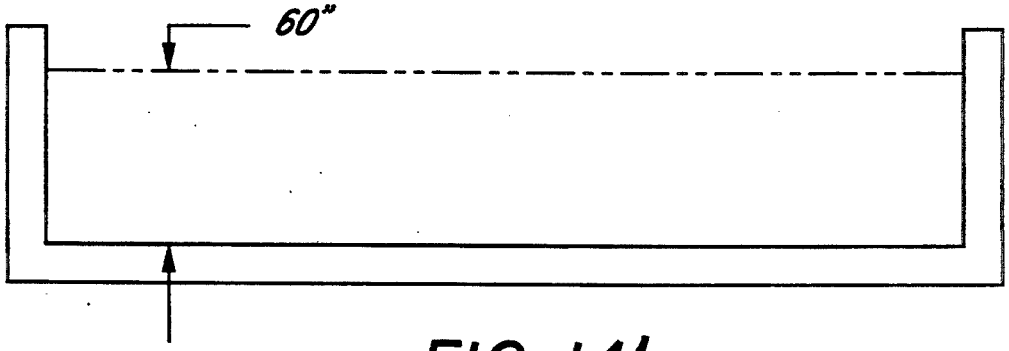
Figure 14C:
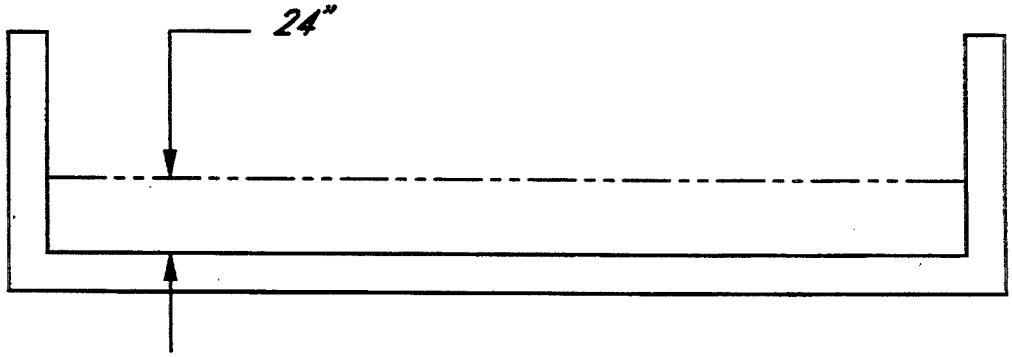
Figure 14D:
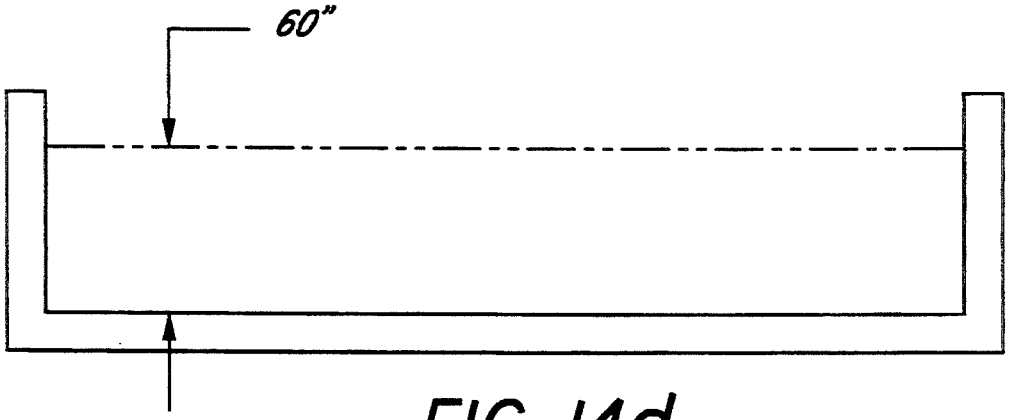
Figure 14E:
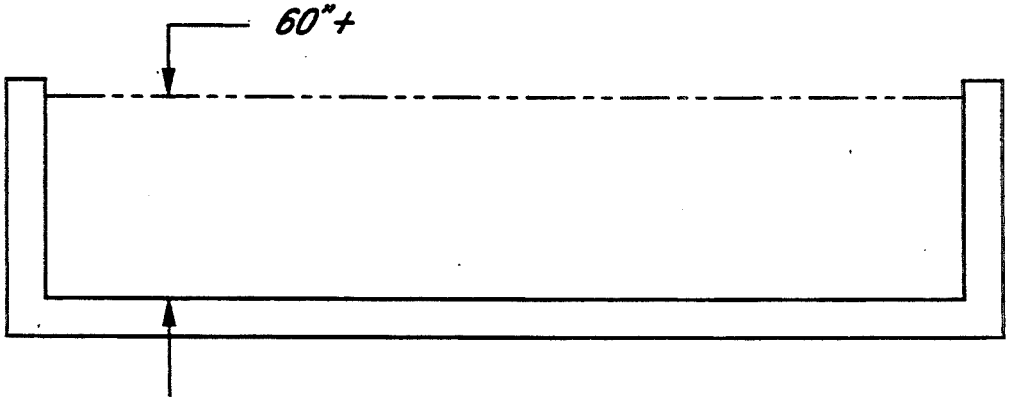

In particular, reverse waves and counter-flowing colliding waves can be generated in the river of FIG. 10. This can be accomplished in cooperation with solitary waves generated at the discharge point by the connected ride. These effects are described below in more detail and illustrated in FIGS. 13, and 14*a–e*. However, before describing these effects, an understanding of the dual sump chamber of FIGS. 13 and 12 is necessary.

Figure 11:
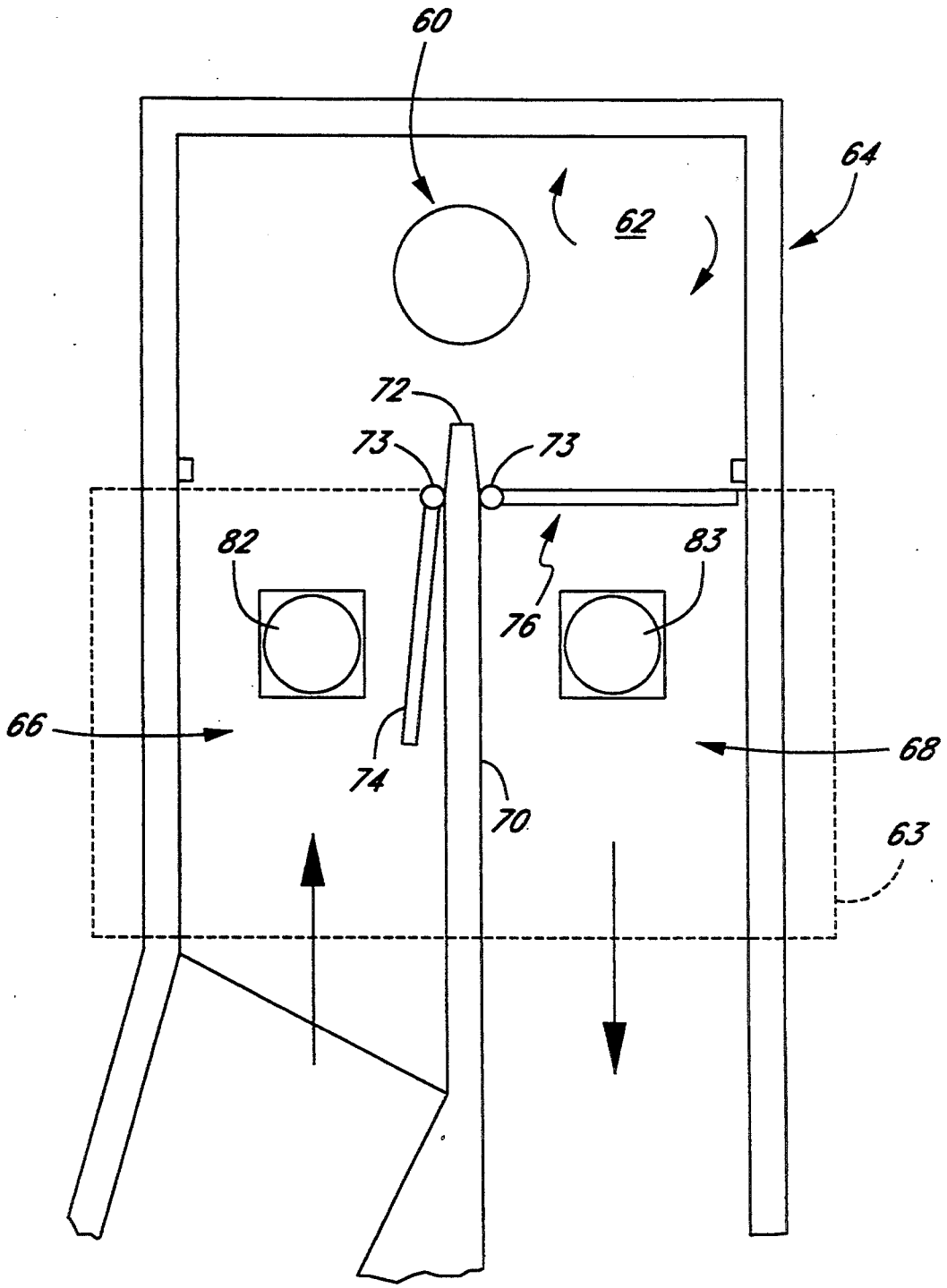
FIG. 11 is a top plan view of the action river of FIG. 10, illustrating in greater detail the tool sump chamber thereof.

Referring first to FIG. 11, there is shown a top elevational view of the dual diversion sump chamber 64 as shown in FIG. 10. In this case, the left sump channel 66 is shown entering the sump chamber from grate #1 and the right sump channel 68 is shown entering the common sump chamber from grate #2. A wall 70 separates these two sump channels 66 and 68 so that there is no co-mingling of water between them until they converge at the common sump. At the beginning of the wall 72, there is a hinged point 72 at which two sump channel doors or gates are hinged. Door 74 is hinged so as to operate between the open position shown in FIG. 11 and a closed position which prevents the flow of water from sump channel 66 into the sump. Door 76 is shown hinged so as to operate between its closed position, as shown in FIG. 11, and an open position, which permits water communication between the sump channel and the sump.

The doors 74 and 76 are coordinated to work simultaneously such that when one door opens, the other door is closed. Thus, referring to FIG. 11, such door 74 is opened, door 76 is closed. If door 76 were to open, door 74 would automatically be closed. This arrangement is desirable in order to achieve the wave effects in the river. However, if both grates #1 and #2 are intended to operate either both in a suction bode or both in a discharge mode, an override is available to maintain both doors in an open position.

Referring to FIG. 12, there is shown situated above the sump 62 and pump 60 a divided tank 78. The tank is divided into two sections, a water ride surge tank situated directly above the pump, and a river surge tank which is separated from the water ride surge tank by a wall 80. The wall 80 does not completely divide the two tanks in order to permit water flow from the water ride surge tank into the river surge tank, as illustrated in FIG. 12. Thus, it will be understood that water can accumulate in the water ride surge tank for discharge through the nozzle 36, shown in FIG. 12, to produce a surge or solitary wave in the river, as explained above. At the same time, water can be accumulated in the river surge tank in order to permit, at an appropriate time, a river surge through discharge points grate #1 or grate #2, as described below. Furthermore, the divided tank can permit uninterrupted flow of water into the connected water ride while also permitting independent surging in the river through the adjoining tank.

In order to permit the grates #1 or #2 to serve as a discharge point, the door in the respective sump channel must be closed and a surge valve situated in the floor of the tank and above the appropriate sump channel must be opened. Two valves, valve #2 (82) and valve #1 (83), are provided above sump channels 66 and 68, respectively, as illustrated in FIGURE 11. For ease of illustration, only a single surge valve 82 is illustrated in FIG. 12; although, it would be understood that both valves operate in a similar fashion. Furthermore, valves #1 and #2 are coordinated, just like the doors, such that when valve #1 is opened, valve #2 is closed, and vice versa. Moreover, the valves are coordinated with the doors, such that when door #1 is opened, valve #1, located above the opposite sump channel, is also opened, and vice versa.

Thus, in accordance with the sump chamber of FIGS. 11 and 12, when one grate is operating in a suction mode, the opposite grate can simultaneously operate in a surge or discharge mode. For example, if it is desired that grate #2 should function in a discharge mode, with grate #1 operating in a suction mode, then the valves and doors can be arranged as shown in FIGS. 11 and 12. That is, door #1 (74) is opened and valve #2 (82) is closed such that water will flow from the high pressure area at the bottom of the river on side 1 at the location of grate #1 to the low pressure area generated in the sump due to the operation of the pump. At the same time, with door #2 in the closed position, and valve #1 opened, water will flow out of the river surge tank, through valve #1, and through sump channel 68 to the grate #2 in order to provide a discharge into the river. This effect can be reversed simply by reversing the position of the respective valves and doors such that grate #1 acts as a discharge and grate #2 acts as a suction point.

The embodiment of FIGS. 10–12 can create unique wave effects in the river course. For example, multiple solitary waves can be generated in the river with the multiple discharge points illustrated in FIG. 10. In particular, a reverse wave can be created in which the second discharge (from, for example, grate #1 or grate #2) is provided so that a solitary wave is generated in a direction counter to the prevailing direction of river flow. Such a second discharge can be in a horizontal, tangential direction to the river loop, and in a direction that is opposite to the river flow. This method of surge discharge has the advantage of generating spectacular white water rapid effects at the point of impact and further generates an upstream propagating solitary bore. However, it will also result in significant energy loss due to turbulence and/or reduction in velocity of circulating river loop water. In other words, the two counter opposing flow act to cancel each other out. Despite this cancellation effect, however, an adequate river loop circulation velocity in the previous prevailing direction can still result from the generation of counter opposing flows at differential flow velocities.

Another type of discharge that can generate a reverse wave involves the introduction of a large water surge at a direction which is perpendicular to the river flow. Such a perpendicular river surge injection can occur from the top, bottom or side of the river. However, for ease of discussion, a bottom perpendicular surge injected through a floor grate, as described in FIGS. 10–12, will be described. Such a bottom perpendicular surge is preferred in that it avoids excess energy and water loss due to splash-out.

A perpendicular bottom surge injection into the river results in two solitary waves that move in opposite directions in the river and outward from the discharge point. One solitary wave moves in the upstream direction and can be referred to as a "reverse wave," while the other solitary wave moves downstream. When a pre-existing flow is circulating in the river loop at a given velocity, the upstream solitary wave generated by the perpendicular surge is visibly larger than the downstream solitary wave. Downstream floating riders encounter this unique upstream moving wave to create an advantageously dramatic effect. A temporary localized flow cancellation effect occurs as the upstream moving solitary wave progresses around the river loop; however, since the upstream and downstream solitary waves are initially equivalent in velocity, the overall net effect upon a pre-existing flow circulation is nominal, i.e., only a slight loss of energy is experienced due to turbulent flow interaction.

Such perpendicular surges introduced into the river in combination with a tangentially introduced surge from the connected water ride, when properly timed together, can result in dramatic collisions of downstream and upstream surges. These spectacular water effects occur due to the momentary summation of the two countermoving waves. The actual locations within the river loop of the summation/collision point will vary depending upon the timing and location of each surge release. Such perpendicular surges discharged into the river through grates #1 or #2 can be timed to coincide with a solitary wave generated from the discharge point of a connected ride or can be generated independently.

FIG. 13 illustrates an example of the foregoing. Grates #1 and #2 are activated in FIG. 13 in accordance with the door and valve conditions shown in FIGS. 11 and 12. That is, as merely one example of the above-described effects, grate #1 (124) is set in the suction mode and grate #2 (122) is set in the discharge mode, as illustrated in FIG. 11. Under these conditions, a perpendicular surge can be injected into the river through grate #2 to create upstream and downstream solitary waves. As this occurs, a deepening 130 of the water level in the vicinity of grate #2 is created such that a so-called reverse flow is generated, as shown in FIG. 13. This reverse flow takes the form of a solitary wave moving upstream. Simultaneously, a solitary wave also is generated in the downstream direction. If the connected ride had previously generated a solitary wave moving in the prevailing direction around the river, a collision may occur in the vicinity 132 indicated in FIG. 13. Under these conditions, spectacular water effects can be obtained.

FIGS. 14*a–e* illustrate in cross-sectional fashion the change in water level experienced in the river as these effects are generated. First, in FIGS. 14a-e, the water level may be substantially equal at all points in the river. However, when a surge is released from the connected ride, the water level on side A of the river begins to rise. At the same time, due to increased suction, the water level on side B of the river in the vicinity of the suction function of grate #2 will decrease substantially. However, as grate #2 is fluctuated to the surge mode, the water level in the vicinity of grate #2 increases substantially in order to create the reverse flow described above.

Figure 15:
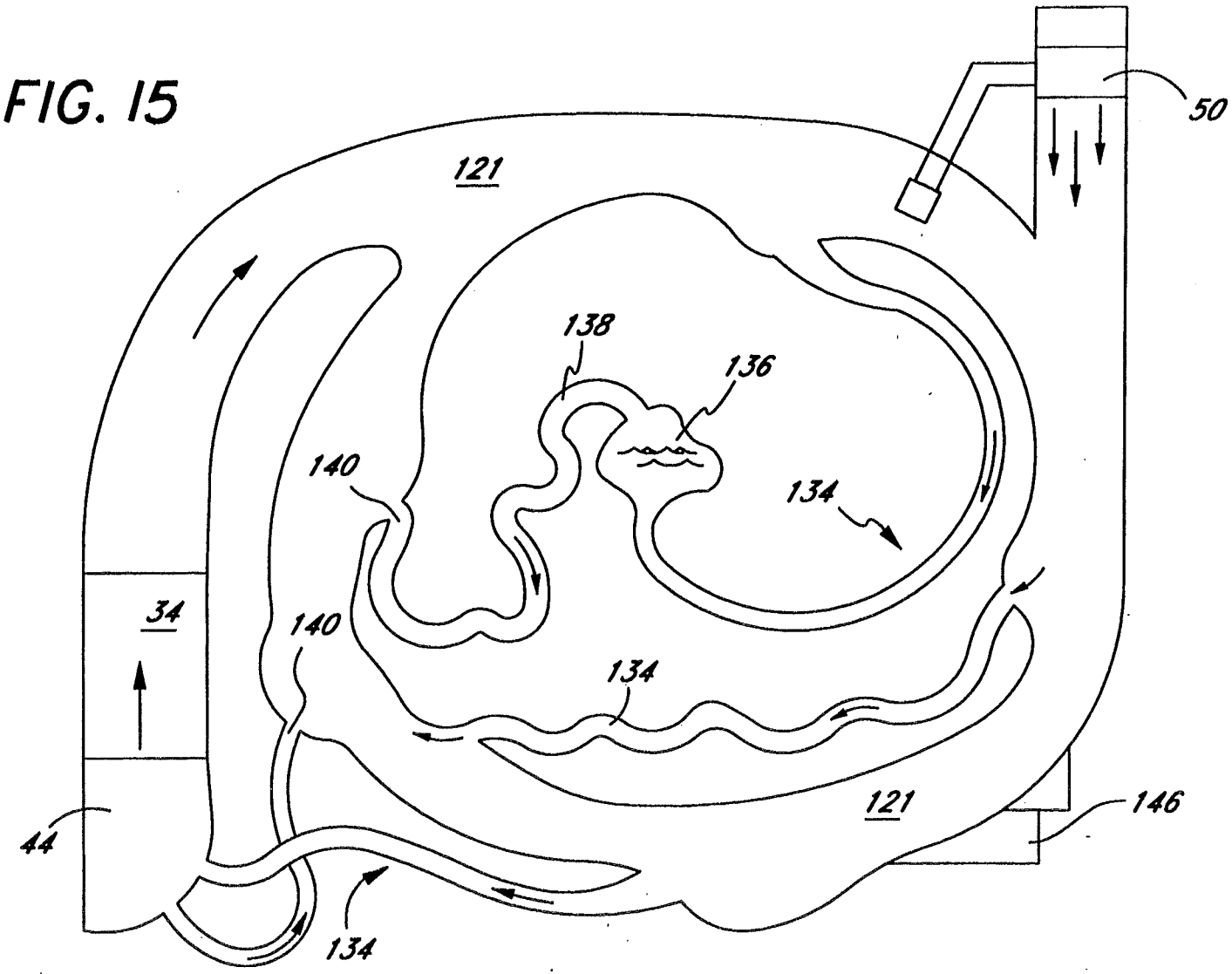
FIG. 15 is a schematic of a river loop system showing a sheet wave generator, and several other tangentially connected water rides.

In another embodiment, the river loop 121 may have tangentially connected water injected flume channels 134, wherein the rider enters the flume horizontally and is driven by water propulsion upward on the flume course. The flume course can consist of various configurations, including a serpentine-type course where the flume is curvilinear and goes through slight variations in elevation, as can be seen in FIG. 15. The water injected flume can also consist of an upwardly moving flow which carries the rider to the top of a mound, where a pool of water 136 is situated, as can be seen in FIG. 15. From this pool of water, in one embodiment, a conventional water slide 138 may be connected to allow the rider to slide down the mound and back into the river loop. The discharge area 140 from the water slide into the river loop advantageously comprises a cove area which prevents the exiting rider from colliding with other riders in the river loop.

In another embodiment, two river loops,one smaller than the other, can be positioned so that one loop is inside the other loop, divided by a common wall. A surge can be introduced into one loop, causing the surge to flow around the loop, and partially over the common wall into the other loop.

As can be seen by the discussion of the present invention, the active river loop configuration can be large enough to incorporate as many rides as is feasible. The river loop itself can take on any configuration and does not necessarily have to be a loop. Various interconnecting river paths and off-shoots may also be incorporated into the system. At any point along the river loop, a separate tangentially connected water ride 146 can also be positioned. Due to the flexibility of placement and location within the water park, an infinite number of possibilities exist.

In conclusion, the present invention embodies several marked improvements over water rides and lazy river rides of the prior art.

What is claimed is:

1. A water attraction for amusement parks, water parks, and the like, said attraction comprising:

a channel forming an endless loop containing a flowing body of water, wherein said flow may be affected by modifications to the dimensions of said channel, and wherein a rider may ride on said flowing body of water; and at least one water ride having an inlet end and an outlet end, said inlet and outlet ends being tangentially interconnected to said channel, said at least one water ride comprising a ride surface thereon and at least one water releasing mechanism for injecting a flow of water onto said ride surface wherein said rider may ride on said at least one water ride, and then may enter said channel and ride said flowing body of water in said channel and then re-enter said at least one water ride directly from said channel without having to exit said flowing body of water.

2. The water attraction of claim 1, wherein said ride surface includes an incline surface onto which said flow of water is injected, such that said rider may perform water skimming maneuvers thereon.

3. The water attraction of claim 2, wherein said ride surface includes an incline surface followed by a decline surface relative to said flow.

4. The water attraction of claim 1, wherein said flow of water from said water ride merges with and drives said unidirectional flowing body of water in said channel.

5. The water attraction of claim 1, wherein a slide is further provided adjacent said at least one water ride adapted to allow said rider to enter said at least one water ride.

6. The water attraction of claim 1, wherein said flow of water is injected onto said ride surface in a first direction which is substantially away from said water releasing mechanism.

7. The water attraction of claim 6, wherein a slide is further provided and is tangentially connected to said ride surface such that said rider enters onto said ride surface in a second direction versus said flow of water.

8. The water attraction of claim 6, wherein a slide is tangentially connected to said ride surface and permits said rider to enter onto said ride surface in a direction which is substantially in said direction of said flow of water.

9. The water attraction of claim 1, wherein said water releasing mechanism comprises at least one nozzle.

10. The water attraction of claim 1, wherein said flow of water on said water ride is a sheet flow upon which said rider can perform water skimming maneuvers thereon.

11. The water attraction of claim 1, wherein said ride surface is followed by a substantially horizontal surface, said horizontal surface permitting said flow of water to travel horizontally at the point where said flow of water merges with said flowing body of water in said channel.

12. The water attraction of claim 11, wherein the elevation of said flow of water on said horizontal surface is substantially the same as the elevation of said flowing body of water in said channel at said point of merging, wherein an efficient transfer of momentum and kinetic energy is provided.

13. The water attraction of claim 1, wherein said channel comprises an endless loop having various twisting and turning portions thereof wherein said flowing body of water can circulate around said loop to produce various simulated river effects.

14. The water attraction of claim 1, wherein the elevation of said water in said channel is substantially uniform.

15. The water attraction of claim 1, wherein said channel is between three meters to 15 meters wide.

16. The water attraction of claim 1, wherein said channel is substantially U-shaped in cross-section.

17. The water attraction of claim 1, wherein said channel has a bottom surface and two side walls.

18. The water attraction of claim 1, wherein said channel is formed of concrete.

19. The water attraction of claim 1, wherein said channel is made of fiberglass.

20. The water attraction of claim 1, wherein said channel is made of steel.

21. The water attraction of claim 1, wherein said channel is coated with a sealant to seal said channel to prevent leakage.

22. The water attraction of claim 1, wherein a second water ride is provided having an inlet and outlet end tangentially interconnected to said channel such that said rider riding on said flowing body of water in said channel may enter directly onto said second water ride without exiting said channel.

23. The water attraction of claim 22, wherein said rider riding on said second water ride may exit said second water ride directly into said channel.

24. The water attraction of claim 22, wherein said second water ride comprises a water injected flume adapted to propel said rider along various elevational changes from an entry area adjacent said channel to an exit area adjacent said flowing body of water in said channel.

25. The water attraction of claim 22, wherein said second water ride comprises a conventional water slide.

26. The water attraction of claim 1, wherein at least one exit is provided along said channel such that said rider riding on said flowing body of water in said channel may exit directly from said channel.

27. The water attraction of claim 1, wherein a second water ride is tangentially interconnected to said channel, said second water ride having a mechanism for injecting a flow of water in a manner similar to said water ride which transfers momentum and kinetic energy from said second water ride to drive said flowing body of water in said channel.

28. The water attraction of claim 1, wherein a periodic wave generator is provided adjacent said channel to form secondary wave formations in said channel.

29. The water attraction of claim 1, wherein a slide is provided adjacent said at least one water ride such that said rider may exit said at least one water ride and enter directly into said channel via said slide.

30. The water attraction of claim 1, wherein a suction area in said channel is provided to remove water from said channel, said removed water being recirculated to supply said water ride.

31. The water attraction of claim 30, wherein said suction area is located in said channel at a location which is behind the point at which said flow of water merges with said flowing body of water in said channel, relative to said flow.

32. The water attraction of claim 30, wherein said suction area is positioned substantially behind said merging point at a distance not greater than one-half the entire distance of said channel.

33. The water attraction of claim 1, wherein an elevated tank is provided adjacent said at least one water ride, said elevated tank being capable of releasing a large quantity of water to form a progressive wave in said channel.

34. The water attraction of claim 1, wherein said channel is configured to provide various rapid effects within said channel.

35. The water attraction of claim 1, wherein at least one of said water rides is a multiple effects water ride comprising:

a water injected flume having one end forming an inlet end of said multiple effects water ride wherein a rider may enter said water injected flume directly from said channel and be propelled upward along an inclined ride surface;

a transition pool disposed at the other end of said water injected flume for receiving said rider and providing a temporary queuing or resting area therefor; and a water slide connected to said transition pool and forming the outlet end of said multiple effects water ride for allowing said rider to slide back down into said channel.

36. A water attraction for amusement parks, water parks, and the like, said attraction comprising:

a channel containing a predominantly unidirectional flowing body of water, wherein said flow is effected by modifications to the dimensions of said channel, and wherein a rider may ride on said flowing body of water; and a water ride tangentially interconnected to said channel and having a ride surface thereon comprising an incline surface with a reverse slide located adjacent said incline surface, said water ride comprising at least one water releasing mechanism for injecting a flow of water onto said ride surface, said flow of water flowing from said ride surface being substantially unattenuated such that it transfers momentum and kinetic energy from said water ride to drive said unidirectional flowing body of water into said channel, wherein said rider may ride on said water ride, and then may enter said channel and ride said flowing body of water in said channel.

37. The water attraction of claim 36, wherein said incline surface is tilted slightly such that said rider riding on said incline surface will tend to move toward said reverse slide.

38. The water attraction of claim 37, wherein said reverse slide comprises a concave declining surface onto which said rider can exit directly from said water ride and into a trough.

39. The water attraction of claim 38, wherein said trough is connected to said channel to permit said rider to enter said channel from said trough.

40. A water attraction for amusement parks, water parks, and the like, said attraction comprising:

a channel containing a predominantly unidirectional flowing body of water, wherein said flow is affected by modifications to the dimensions of said channel, and wherein a rider may ride on said flowing body of water;

a water ride tangentially interconnected to said channel and having a ride surface thereon, said water ride comprising at least one water releasing mechanism for injecting a flow of water onto said ride surface, said flow of water flowing from said ride surface being substantially unattenuated such that it transfers momentum and kinetic energy from said water ride to drive said unidirectional flowing body of water in said channel, wherein said rider may ride on said water ride, and then may enter said channel and ride said flowing body of water in said channel; and an exit ramp tangentially situated along said channel comprising a water injected flume which propels said rider upward from said channel.

41. A water attraction for amusements parks, water parks, and the like, said attraction comprising:

a channel forming an endless loop for containing a flowing body of water, wherein a rider may ride on said flowing body of water; and a water ride interconnected to said channel, said water ride comprising a sheet flow generator which propels a sheet flow of water onto a riding surface upon which said rider can perform skimming maneuvers thereon, wherein the momentum and kinetic energy of said flow of water exiting from said riding surface substantially drives said flowing body of water in said channel in a unidirectional manner, and creates various water effects in said channel.

42. The water attraction of claim 41, wherein the surface of said channel is modified and configured to cause various rapid effects within said channel.

43. The water attraction of claim 41, wherein said channel forms a loop such that said flowing body of water flows predominantly in a unidirectional manner.

44. The water attraction of claim 41, wherein a slide is provided to permit said rider to enter directly onto said riding surface from an entry area adjacent said channel.

45. The water attraction of claim 41 wherein a second water ride is interconnected to said channel such that said rider can enter directly onto said second water ride from said channel without exiting said body of water in said channel.

46. The water attraction of claim 45, wherein said rider riding on said second water ride may exit directly from said second water ride into said channel.

47. The water attraction of claim 41, wherein said water rides is a multiple effects water ride comprising:

a water injected flume having one end forming an inlet end of said multiple effects water ride wherein a rider may enter said water injected flume directly from said channel and be propelled upward along an inclined ride surface;

a transition pool disposed at the other end of said water injected flume for receiving said rider and providing a temporary queuing or resting area therefor; and a water slide connected to said transition pool and forming the outlet end of said multiple effects water ride for allowing said rider to slide back down into said channel.

48. A water attraction for amusement parks, water parks, and the like, said attraction comprising:

a channel for containing a flowing body of water, wherein a rider may ride on said flowing body of water;

a water ride interconnected to said channel, said water ride having a riding surface upon which said rider can perform maneuvers thereon, said water ride also having at least one water releasing mechanism to provide a flow of water onto said riding surface, wherein the momentum and kinetic energy of said flow of water flowing from said riding surface substantially drives said flowing body of water in said channel in a unidirectional manner, and creates various water effects in said channel; and a second water ride interconnected to said channel such that said rider can enter directly onto said second water ride from said channel without exiting said channel said second water ride comprising a water injected flume which propels said rider along various elevational changes from an entry area adjacent said channel to an exit area adjacent said channel.

49. The water attraction of claim 48, wherein a tank is provided to permit a large quantity of water to be stored and released to create a progressive wave which travels from said water ride through said channel.

50. The water attraction of claim 48, wherein the suction of water is removed from said channel at a suction area which is located behind and away from the location at which said flow of water enters said channel.

51. The water attraction of claim 48, wherein a containment wall is provided along said channel to prevent said flow of water from escaping said channel.

52. The water attraction of claim 48, wherein said riding surface comprises an incline portion followed by a decline portion.

53. The water attraction of claim 48, wherein said channel is no more than one meter deep.

54. The water attraction of claim 48, wherein simulated rock formations are provided in said channel to create various water rapid effects in said channel.

55. The water attraction of claim 54, wherein said simulated rock formations are made of resilient material.

56. The water attraction of claim 48, wherein said flow of water enters said channel in a direction that is parallel or at least tangential to the direction of said flowing body of water in said channel.

57. A system for transporting a rider from one water ride to another water ride for amusements parks, water parks, and the like, said system comprising:

a channel of water containing a predominantly unidirectional flowing body of water, wherein a rider may ride on said flowing body of water;

a first water ride tangentially interconnected to said channel, said first water ride having at least one water releasing mechanism to provide a flow of water which transfers momentum and kinetic energy to drive said unidirectional flowing body of water in said channel; and a second water ride interconnected to said channel, said second water ride comprising a water injected flume which propels said rider along various elevational changes from an entry area adjacent said channel to an exit area adjacent said channel wherein said rider may ride on said flowing body of water in said channel, and then may enter said second water ride directly from said channel and ride said second water ride.

58. The system of claim 57, wherein a third water ride is interconnected to said channel, wherein said rider may ride on said flowing body of water in said channel and may enter directly onto said third water ride.

59. The system of claim 57, wherein said flowing body of water in said channel is affected by modifications to the dimensions of said channel.

* * * * *